US007520205B1

(12) United States Patent
Colliflower et al.

(10) Patent No.: US 7,520,205 B1
(45) Date of Patent: Apr. 21, 2009

(54) ANTI-BALLISTIC MATERIALS AND PROCESS

(75) Inventors: Gerald B. Colliflower, Henderson, NC (US); Anne B. Colliflower, legal representative, Henderson, NC (US); Gale Leslie Quinn, Arnold, MD (US); James G. Quinn, Jr., Arnold, MD (US); Prentice J. Perry, Burlington, NC (US)

(73) Assignee: Antiballistic Security and Protection, Inc., Arnold, MD (US)

( * ) Notice: Subject to any disclaimer, the term of this patent is extended or adjusted under 35 U.S.C. 154(b) by 0 days.

(21) Appl. No.: 10/563,228

(22) PCT Filed: Jul. 1, 2004

(86) PCT No.: PCT/US2004/020989

§ 371 (c)(1),
(2), (4) Date: Sep. 26, 2007

(87) PCT Pub. No.: WO2005/043071

PCT Pub. Date: May 12, 2005

Related U.S. Application Data

(60) Provisional application No. 60/567,795, filed on May 5, 2004, provisional application No. 60/521,336, filed on Apr. 2, 2004, provisional application No. 60/483,630, filed on Jul. 1, 2003.

(51) Int. Cl.
*F41H 5/04* (2006.01)

(52) U.S. Cl. ..... 89/36.02; 109/80

(58) Field of Classification Search ..... 89/36.01, 89/36.02, 36.04; 109/49.5, 78, 80
See application file for complete search history.

(56) References Cited

U.S. PATENT DOCUMENTS

| | | | | | |
|---|---|---|---|---|---|
| 4,404,889 | A | * | 9/1983 | Miguel | 89/36.02 |
| 4,822,657 | A | * | 4/1989 | Simpson | 428/69 |
| 5,060,582 | A | * | 10/1991 | Salzer | 109/49.5 |
| 5,185,195 | A | * | 2/1993 | Harpell et al. | 428/102 |
| 5,257,583 | A | * | 11/1993 | Koenig | 109/49.5 |
| 5,370,034 | A | * | 12/1994 | Turner et al. | 89/36.02 |
| 5,469,796 | A | * | 11/1995 | Koenig | 109/49.5 |
| 5,767,435 | A | * | 6/1998 | Reymann | 89/36.02 |
| 6,082,240 | A | | 7/2000 | Middione et al. | |
| 6,532,857 | B1 | | 3/2003 | Shih et al. | |
| 6,826,996 | B2 | | 12/2004 | Strait | |

OTHER PUBLICATIONS

International Search Report No. PCT/US04/20989, dated Jun. 27, 2005, 1 page.

* cited by examiner

*Primary Examiner*—Bret Hayes
(74) *Attorney, Agent, or Firm*—Novak Druce & Quigg, LLP

(57) ABSTRACT

An antiballistic armored panel (200) comprising at least an interior surface (201), a first panel (205) adjacent to the interior surface and mounted in a plurality of tracks (203), a first set of AramidFiber sheets (207A) adjacent and attached to the first panel, a second set of Aramid sheets (207B) attached to the first set of Aramid-Fiber sheets, a first backer board (209) adjacent and attached to the second set of Aramid-Fiber sheets, a layer of tiles (211) adjacent and attached to the first backer board, and a second backer board (213) adjacent and attached to the layer of tiles. A second panel (615) may be attached adjacent to the second backer board along with a layer of forced entry steel mesh (919) to provide anti-forced entry capability to the antiballistic armored panel.

93 Claims, 27 Drawing Sheets

200
201
225
205
207A
207B
209
211
203
213

ANTI-BALLISTIC MATERIALS AND PROCESS

CROSS-REFERENCE TO RELATED APPLICATIONS

This application is an International Patent application claiming priority from pending U.S. Provisional Application Ser. No. 60/483,630 filed on Jul. 1, 2003 by Colliflower et al., entitled ANTI-BALLISTIC MATERIALS AND PROCESS, Application Ser. No. 60/521,336 filed on Apr. 2, 2004 by Colliflower et al., entitled ARMORE PANELS, METHODS OF MAKING AND ASSEMBLING THEREOF AND METHODS OF INCORPORATING ARMOR PANELS IN VEHICLES AND STRUCTURE, and U.S. Provisional Application Ser. No. 60/567,795 filed on May 5, 2004 by Colliflower et al., entitled STEP BY STEP LAYERS OF ASAP BAM-LA WALL, the entire contents of which are incorporated by reference and for which claims priority benefit under Title 35, United States Code §119(e).

BACKGROUND

The technical field is antiballistic materials and armored panels constructed therefrom. The technical field also includes construction techniques incorporating armored panels in vehicles and other structures.

Many forms of antiballistic materials and barriers are available. Such materials are classified according to their ability to deter ballistic attacks. Underwriters Laboratories (UL) Standard for Safety for Bullet-Resisting Equipment (i.e., UL-752 requirements) covers materials, devices, and fixtures used to form bullet-resisting barriers that protect against robbery or holdup. The term "bullet-resisting" generally signifies that protection is provided against complete penetration, passage of fragments of projectiles, or spalling (i.e., fragmentation of the protective material) to the degree that injury would be caused to a person standing directly behind the bullet-resisting barrier.

The UL-752 requirements are classified according to levels, beginning at Level 1. Higher UL levels provide greater protection against projectiles. However, greater protection against ballistic attack typically requires heavier and larger ballistic materials. When the object to be protected is a building, the total weight of any antiballistic shielding is limited by the ability of the building to support the additional weight of the shielding. For example, conventional shielding for buildings and other structures involves adding concrete or steel layers to the building walls. These layers of shielding material add considerable weight to buildings and other structures. In particular, due to this added weight, conventional shielding materials may not be suitable for taller buildings and other structures. Additionally, conventional shielding materials, such as steel, are costly. Moreover, mobile objects requiring antiballistic shielding are similarly subject to the same or even more stringent weight and cost limitations.

SUMMARY

The present invention is an apparatus and method for providing an antiballistic armored wall panel comprising at least an interior surface, a first panel adjacent to the interior surface and mounted in a plurality of tracks, a first set of Aramid-Fiber sheets adjacent and attached to the first panel, a second set of Aramid sheets attached to the first set of Aramid-Fiber sheets, a first backer board adjacent and attached to the second set of Aramid-Fiber sheets, a layer of tiles adjacent and attached to the first backer board, and a second backer board adjacent and attached to the layer of tiles. A second panel may be attached adjacent to the second backer board along with a layer of forced entry steel mesh to provide anti-forced entry capability to the antiballistic armored panel One embodiment of the present invention is an apparatus for an interior antiballistic armored panel for mounting on a structure, comprising: a plurality of tracks mounted to the structure; a second backer board attached to the a plurality of tracks; a layer of tiles attached to the second backer board; a first backer board attached to the layer of tiles; a second set of Aramid-Fiber sheets attached to the layer of tiles; a first set of Aramid-Fiber sheets attached to the second set of Aramid-Fiber sheets; a first panel with a second side attached to the first set of Aramid-Fiber sheets and with a top and bottom portion mounted to the a plurality of tracks; a plurality of lips mounted to the plurality of a plurality of tracks; and an interior surface attached to at least one of a first side of the first panel and the plurality of lips, wherein at least one of self-tapping screws, fasteners and welding are used for mounting the plurality of tracks, first panel and the plurality of lips, and at least one of adhesives and tape are used for attaching the interior surface, first panel, Aramid-Fiber sheets, backer boards and layer of tiles.

Another embodiment of the present invention is a method for making an interior antiballistic armored panel for mounting on a structure, comprising: mounting a plurality of tracks on the structure; attaching a second backer board to the a plurality of tracks; attaching a layer of tiles to the second backer board; attaching a first backer board to the layer of tiles; attaching a second set of Aramid-Fiber sheets to the first backer board; attaching a first set of Aramid-Fiber sheets to the second set of Aramid Fiber sheets; attaching a second side of a first panel to the first set of Aramid-Fiber sheets; mounting a top and bottom of the first panel to the a plurality of tracks; mounting a plurality of lips to the plurality of tracks; attaching an interior surface to first side of the first panel, wherein at least one of self-tapping screws, fasteners and welding are used for mounting the plurality of tracks and the first panel, and at least one of adhesives and tape are used for attaching the interior surface, first panel, Aramid-Fiber sheets, backer boards and layer of tiles.

Yet another embodiment of the present invention is an apparatus for an antiballistic armored panel for mounting on a structure, comprising: a plurality of tracks mounted to the structure; a first panel mounted at a top and bottom portion to the a plurality of tracks; a first set of Aramid-Fiber sheets attached to a second side of the first panel; a second set of Aramid-Fiber sheets attached to the first set of Aramid-Fiber sheets; a first backer board attached to the second set of Aramid-Fiber sheets; a layer of tiles attached to the first backer board; a second backer board attached to the layer of tiles; a second panel attached on a first side to the second backer board and mounted at a top and bottom portion to the a plurality of tracks; a plurality of lips mounted to the plurality of tracks; an exterior surface attached to a second side of the second panel; and an interior surface attached to a first side of the first panel, wherein at least one of self-tapping screws, fasteners and welding are used for mounting the plurality of tracks, first panel, second panel and the plurality of lips, and at least one of adhesives and tape are used for attaching the Aramid-Fiber sheets, backer boards, layer of tiles, exterior surface and interior surface.

Another embodiment of the present invention is a method for making an antiballistic armored panel for mounting on a structure, comprising: mounting a plurality of tracks on the surface; mounting a top and bottom portion of a first panel to the a plurality of tracks; attaching a first set of Aramid-Fiber sheets to a second side of the first panel; attaching a second set of Aramid-Fiber sheets to the first set of Aramid Fiber sheets; attaching a first backer board to the second set of Aramid-Fiber sheets; attaching a layer of tile to the first backer board; attaching a second backer board to the layer of tiles; attaching a second panel to the second backer board; mounting a top and bottom of the second panel to the a plurality of tracks; mounting a plurality of lips to the plurality of tracks; attaching an exterior surface to a second side of the second panel; finishing the exterior surface with at least one of brick, stone and other external finishing materials; and attaching an interior surface to the first side of the first panel, wherein at least one of self-tapping screws, fasteners and welding are used for mounting the plurality of tracks, first panel, second panel and the plurality of lips, and at least one of adhesives and tape are used for attaching the Aramid-Fiber sheets, backer boards, layer of tiles, exterior surface and interior surface.

Yet another embodiment of the present invention is an apparatus for an antiballistic/anti-forced entry armored panel for mounting on a structure, comprising: a plurality of tracks mounted to the structure; a first panel attached at a top and bottom portion to the a plurality of tracks; a first set of Aramid-Fiber sheets attached to a first side of the first panel; a second set of Aramid-Fiber sheets attached to the first set of Aramid-Fiber sheets; a first backer board attached to the second set of Aramid-Fiber sheets; a layer of tiles attached to the first backer board; a second backer board attached to the layer of tiles; a second panel attached to the second backer board and mounted at the top and bottom to the a plurality of tracks; a hardened steel mesh attached to the second panel by at least one of seaming and continuous welding; horizontal steel frame members attached to the hardened steel mesh by welding; at least one of horizontal rebars, spacers and fasteners attached to the hardened steel mesh by tack welding, located at least at the top and bottom of the second panel and at equally spaced at intervals between the top and bottom of the second panel; a stucco mesh attached to the at least one of horizontal rebars, spacers and fasteners by welding; a plurality of lips mounted to the plurality of tracks and spaced at intervals along edges of the stucco mesh; high strength stucco applied to the stucco mesh; and an interior surface attached to a first side of the first panel, wherein at least one of self-tapping screws, fasteners and welding are used for mounting the plurality of tracks, first panel, second panel and plurality of lips, and at least one of adhesives and tape are used for attaching the Aramid-Fiber sheets, backer boards, layer of tiles and interior surface.

Another embodiment of the present invention is a method for making an antiballistic and anti-forced entry armored panel for mounting on a structure, comprising: mounting a plurality of tracks on the structure; mounting a top and bottom of a first panel to the a plurality of tracks; attaching a first set of Aramid-Fiber sheets to the first panel; attaching a second set of Aramid-Fiber sheets to the first set of Aramid Fiber sheets; attaching a first backer board to the second set of Aramid-Fiber sheets; attaching a layer of tile to the first backer board; attaching a second backer board to the layer of tiles; attaching a second panel to the second backer board; mounting a top and bottom portion of the second panel to the a plurality of tracks; at least one of seaming and continuous welding a hardened steel mesh to the second panel; welding horizontal steel frame members to the hardened steel mesh; tack welding at least one of horizontal rebars, spacers and fasteners at least at the top and bottom of the second panel and at equally spaced intervals between the top and bottom of the second panel; tack welding stucco mesh to the at least one of horizontal rebars, spacers and fasteners; mounting a plurality of lips at intervals spaced along edges of the stucco mesh to the plurality of tracks; applying high strength stucco to the stucco mesh to form an exterior surface; and attaching an interior surface to a first side of the first panel, wherein at least one of self-tapping screws, fasteners and welding are used for mounting the plurality of tracks, first panel, second panel and plurality of tracks, and at least one of adhesives and tape are used for attaching the Aramid-Fiber sheets, backer boards, layer of tiles and interior surface.

Yet another embodiment of the present invention is an antiballistic armored panel capable of achieving up to UL Level 8, said panel comprising one or more of the following materials: gypsum board, a structural pre-insulated light gauge steel component, a commercial grade adhesive and/or tape, cementeous board, commercial grade quarry tiles, tempest mesh Aramid-Fiber sheets and/or KEVLAR®, and wherein said panel comprises less than 25% by weight of reinforced concrete and less than 25% by weight of ballistic steel. Further, the antiballistic armored panel of this embodiment comprises less than 5% by weight of reinforced concrete and less than 5% by weight of ballistic steel. Furthermore, the antiballistic armored panel of this embodiment is free of reinforced concrete and ballistic steel.

Those skilled in the art will appreciate the above stated advantages and other advantages and benefits of various embodiments of the invention upon reading the following detailed description of the embodiments with reference to the below-listed drawings.

According to common practice, the various features of the drawings are not necessarily drawn to scale. Dimensions of various features may be expanded or reduced to more clearly illustrate the embodiments of the invention.

BRIEF DESCRIPTION OF THE DRAWINGS

The detailed description will refer to the following drawings, wherein like numerals refer to like elements, and wherein.

DETAILED DESCRIPTION

The present invention is an apparatus and method for providing antiballistic shielding in armored wall panels and assemblies incorporating armored wall panels. In particular, the present invention is directed to a configuration of composite, lightweight, building materials that creates a barrier against natural and manmade destructive forces. Use of the armored wall panels and assemblies of the present invention may reduce or eliminate the need for materials such as reinforced concrete and ballistic steel in antiballistic shielding applications. The armored wall panels of the present invention may be configured to prevent penetration due to a multiple shot assault from high-powered full metal jacket (FMJ) ballistic projectiles, while maintaining a high UL ballistic rating. In at least one embodiment of the present invention, a UL Level 8 rating has been achieved.

The armored wall panels of the present invention contain an inner matrix of composite, lightweight, building materials that provide part of the barrier against natural and manmade destructive forces. This inner matrix can be assembled separately from the remainder of the armor wall panel. The inner matrix or armored wall panel may be added to existing objects, structures and vehicles, or the armored wall panel can be used in the construction of new objects, structures and vehicles.

The present invention is directed to an antiballistic armor matrix rated at up to UL level 8. In particular, the present invention is directed to a special orientation of composite lightweight building materials that create a resistant barrier against many destructive forces, natural and manmade, without the use of reinforced concrete or ballistic steel. The present invention is designed and tested to contain a multiple shot assault from high-powered FMJ (Full metal jacket) ballistic projectiles, while maintaining a maximum UL Level 8 (i.e., an Underwriters Laboratories testing criteria). The present invention is preferably comprised of one or more of the following materials: fire-rated gypsum board, structural pre-insulated light gauge steel panels/components, commercial grade adhesives or tape, cementeous board, commercial grade quarry tiles, tempest mesh Aramid-Fiber sheets and/or KEVLAR®. In other embodiments the present invention is directed to two or more of the above materials in any combination. The present invention is further directed to methods for forming/making and installing such materials.

Figure 1:
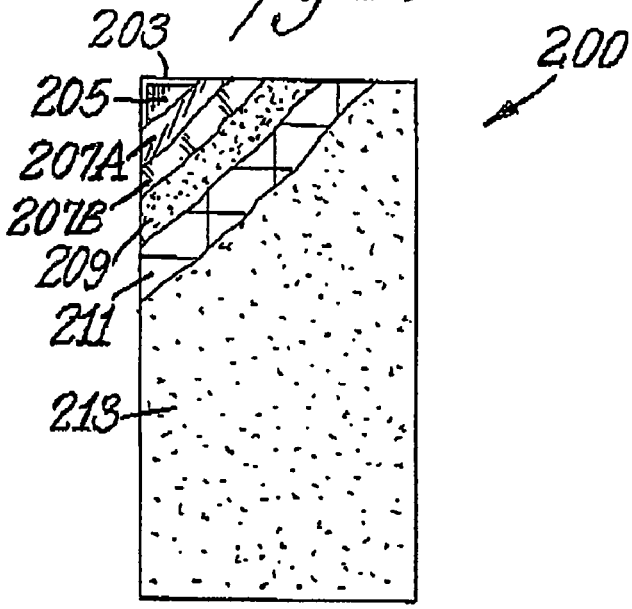
FIG. 1 is an end view of a portion of an interior antiballistic armored wall panel assembly.

FIG. 1 to FIG. 4 illustrates one embodiment of the present invention. FIG. 1 is an end view of a portion of an interior antiballistic armored wall panel assembly 200. FIG. 1 shows a configuration comprising: a plurality of tracks 203, a first panel 205, a first set of Aramid-Fiber sheets 207A, a second set of Aramid-Fiber sheets 207B, a first backer board 209, a layer of tiles 211 and a second backer board 213. In addition, an interior surface 201 and a plurality of lips 225 (not shown) precedes the first panel 205.

Figure 2:
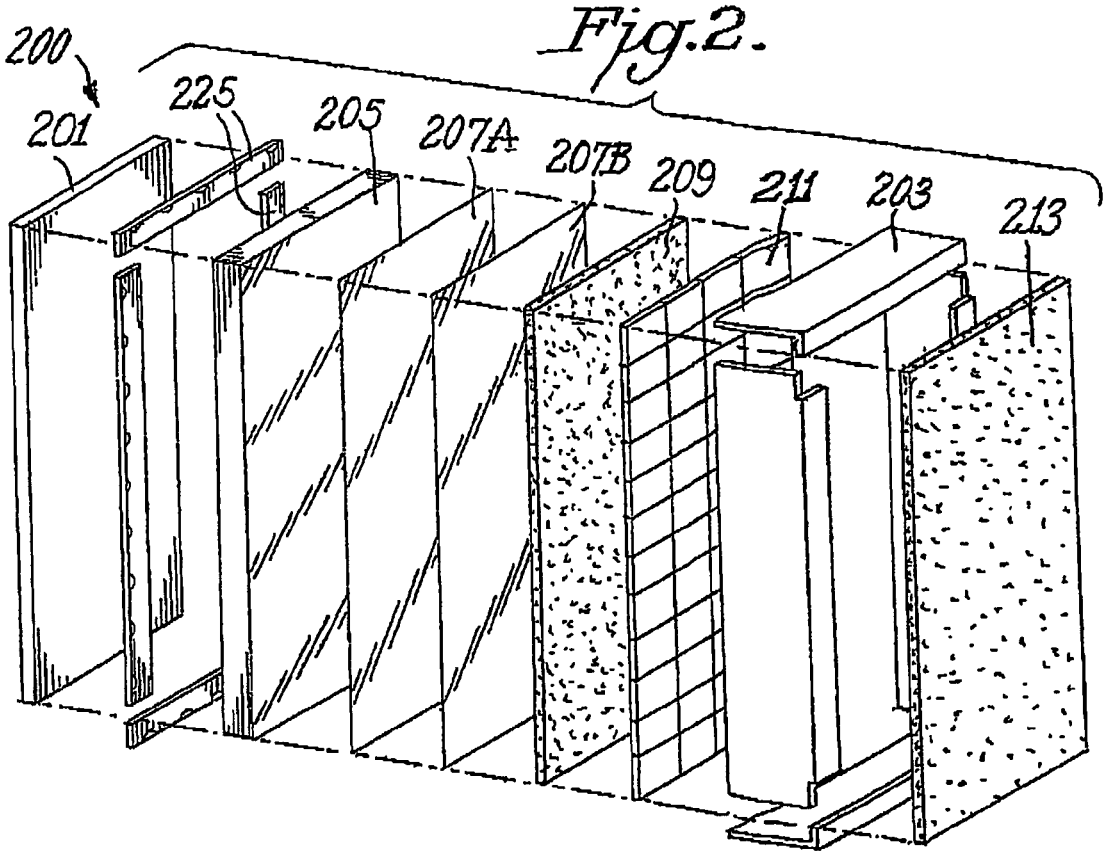
FIG. 2 illustrates an exploded perspective view of the interior antiballistic armored wall panel assembly.

FIG. 2 illustrates an exploded perspective view of the interior antiballistic armored wall panel assembly 200. FIG. 2 shows a configuration comprising: an interior surface 201, a plurality of lips 225, a plurality of tracks 203, a first panel 205, a first set of Aramid-Fiber sheets 207A, a second set of Aramid-Fiber sheets 207B, a first backer board 209, a layer of tiles 211 and a second backer board 213.

Figure 3:
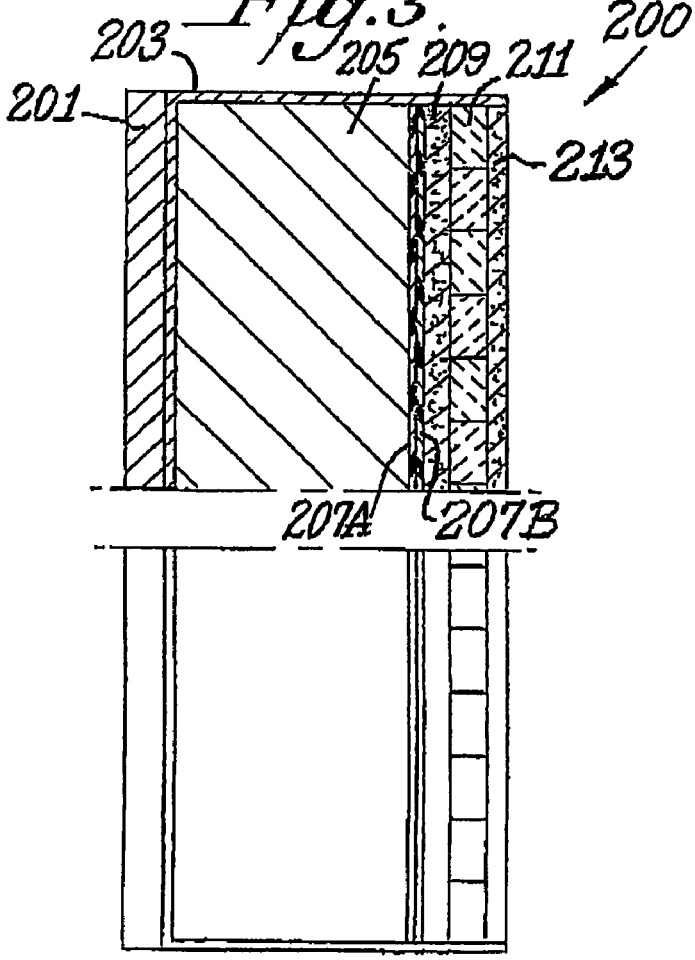
FIG. 3 illustrates a fragmental cross-sectional view of the interior antiballistic armored wall panel assembly.

FIG. 3 illustrates a fragmental cross-sectional view of the interior antiballistic armored wall panel assembly 200. FIG. 3 shows a configuration comprising: an interior surface 201, a plurality of tracks 203, a first panel 205, a first set of Aramid-Fiber sheets 207A, a second set of Aramid-Fiber sheets 207B, a first backer board 209, a layer of tiles 211 and a second backer board 213. In addition, FIG. 3 clearly illustrates the inner matrix comprising: the first set of Aramid-Fiber sheets 207A, the second set of Aramid-Fiber sheets 207B, the first backer board 209, the layer of tiles 211 and the second backer board 213.

The interior surface 201 may be, for example, fire-rated gypsum board or drywall as is known in the construction industry. The interior surface 201 is used as a facing material when the interior antiballistic armored panel 200 is used in residential, commercial and other construction environments.

The plurality of tracks 203 are used to contain and solidify the antiballistic armored panel assembly and provide structural integrity. As a non-limiting example, the plurality of tracks 203 can be made from sheet metal. Other materials, such as galvanized steel and mild steel, can also be used to form the plurality of tracks 203. The plurality of tracks 203 may have a non-limiting height of 3" and a width of 10". The plurality of tracks 203 can be attached to the first panel 205 using, for example, self-tapping drill tip screws, equivalent fasteners or welding.

The first panel 205 may be made, for example, from metals such as light gauge steel. A non-limiting example of such a light gauge steel is THERMASTEEL®, which is manufactured by THERMASTEEL Corp., Radford Va.

The first panel 205 may have varying thicknesses depending upon the desired application. As a non-limiting example, the first panel 205 may have a thickness in the range of about 3½"-7½". The first panel 205 provides a structural, sound-diminishing, insulated, and lightweight carrier for the inner matrix discussed above.

In addition, the first panel 205 may be insulated. Insulation in the polystyrene steel panel 205 may have the form of a rigid, fire-retardant modified expanded polystyrene resin (EPS) bonded to the steel.

The first panel 205 may be used as load-bearing portions of a steel frame structure. Therefore, the interior antiballistic armored panel 200 can be used as a load-bearing element in roofs, floors, and walls.

The first set of Aramid-Fiber sheets 207A and second set of Aramid-Fiber sheets 207B can be a layer of high strength ballistic fiber material. A non-limiting example of such a ballistic fiber material is KEVLAR®. KEVLAR® consists of long molecular chains produced from poly-paraphenylene terephthalamide. KEVLAR® is a polyamide, in which all the amide groups are separated by para-phenylene groups. That is, the amide groups attach to the phenyl rings opposite to each other, at carbons 1 and 4. KEVLAR® is five times stronger than steel, weight for weight. KEVLAR® provides excellent impact resistance and is one of the lightest structural fibers available. KEVLAR® is generally yellow in color and soft to touch. KEVLAR® 29 is used for ballistic protection. KEVLAR® is available from E. I. du Pont de Nemours and Company.

The first set of Aramid-Fiber sheets 207A and second set of Aramid-Fiber sheets 207B can act as spalling liners and therefore provides projectile containment layers. KEVLAR® fibers can be woven into sheets that can be compiled by layering the sheets to the desired number necessary for the protection level necessary (e.g., 4 layer; 9 layer, etc.). In one non-limiting example, first set of Aramid-Fiber sheets 207A and second set of Aramid-Fiber sheets 207B are about ¼" thick.

Alternative materials for the first set of Aramid-Fiber sheets 207A and second set of Aramid-Fiber sheets 207B include the following:

TWARON® is another aramid flexible ballistic laminate material suitable for use in the present embodiments. TWARON® is a lightweight, high strength fiber made from aramid polymer supplied by Accordis. TWARON's® characteristics include good dimensional stability and high modulus.

SPECTRA® is an ultra lightweight, high-strength polyethylene flexible ballistic laminate fiber material developed by Honeywell International Corporation. SPECTRA® has high damage tolerance, non-conductivity, flexibility, high specific modulus and high energy-to-break, low moisture sensitivity, and good UV resistance. SPECTRAL is typically used in ballistic and high impact composite applications.

ZYLON® is another flexible ballistic material. ZYLON® consists of a rigid chain of molecules of poly (p-phenylene-2, 6-benzobisoxazole) (PBO). ZYLON® is available from Toyobo and has excellent tensile strength and modulus properties.

In another non-limiting example, the layers 207A, 207B may be constructed of steel plates. The layers 207A, 207B may be attached, for example, by polyurethane adhesive as discussed above. If steel plates are used, the layers 207A, 207B may have a thickness in the range of about ⅛"-¾. A non-limiting example of steel plates may be mild cold rolled steel plates.

The first backer board 209 and second backer board 213 may be, for example, cementous boards. Moreover, fire-proof cementous backer boards are preferably used because the interior antiballistic armored panel 200 may be used in office buildings or other inhabited structures. The first backer board 209 and second backer board 213 may have a thickness in the range of about ¼"-½". In one non-limiting example, the first backer board 209 and second backer board 213 are about ¼" thick. In another non-limiting example, the first backer board 209 and second backer board 213 are 5/16" thick. The first backer board 209 and second backer board 213 serve as containment layers. A non-limiting example of a backer board is sold under the trade name HARDIBACKER® manufactured by James A. Hardie Siding Products, located in Mission Viejo, Calif.

The layer of tiles 211 may be made from individual tiles. In one non-limiting example, the layer of tiles 211 is made from a ceramic tile such as a quarry tile. Alternative tiles, such as paver tile and equivalents, may also be used. The layer of tiles 211 may have a thickness in the range of about ¼"-½". In one non-limiting example, the layer of tiles 211 is about ½" thick.

The layer of tiles 211 can be constructed from a variety of sizes of tiles such as, for example, at least 6"×6" tiles. The layer of tiles 211 may be formed by being set in an adhesive. As a non-limiting example, the adhesive can be at least one of polyurethane and urethane tile adhesive.

Properties of a non-limiting example of quarry tile suitable for forming the layer of tiles 211 are summarized in Table 1.

TABLE 1

Quarry Tile Specifications

| Test Results | ASTM # | Result |
|---|---|---|
| Breaking Strength | C648 | >350 lbs |
| Scratch Hardness | MOH's | 7 |
| Chemical Resistance | C650 | Resistant |
| Coefficient of Friction | C1028 | Wet ≧ 0.60<br>Dry ≧ 0.80 |

Alternatively, the layer of tiles may 211 may be formed from at least one of commercial grade quarry tiles and ceramic tiles set in a urethane adhesive as used in commercial construction. The urethane adhesive can serve as a bonding agent for the elements of the inner matrix. Non-limiting examples of suitable urethane adhesives for the layer of tiles 211 are sold by Bostik Findley under the trade name CHEM-CALK.

Moreover, adhesives are used to attach/cement adjacent layers of the interior antiballistic armored panel 200. The adhesives used to attach/cement the adjacent layers may be industrial grade adhesives used in the field of commercial construction. Non-limiting examples of such adhesives include polyurethane and urethane. An example of a polyurethane construction adhesive is sold under the trade name PL-BRANDS by OSI Sealants, Inc., of Mentor Ohio.

In addition, tape may be used to attach the adjacent layers of the interior antiballistic armored panel 200. The tapes used to attach the adjacent layers may be industrial grade tapes used in the field of commercial construction. A non-limiting examples of such tapes include double-stick tapes, double coated acrylic foam tapes and adhesive transfer tapes. A non-limiting example of a double-stick tape is sold under the trade name VHB® by 3M®, of Minneapolis, Minn.

A metallic mesh (not shown) can be include in the interior antiballistic armored wall to prevent eavesdropping of electromagnetic emissions from data processing and related equipment may be included in the interior antiballistic armored panel 200. A non-limiting example of such a metallic mesh is TEMPEST® mesh, a fine woven copper wire fabric. The metallic mesh would be grounded to provide a shielded environment. The metallic mesh can be installed between the first panel 205 and first set of Aramid-Fiber sheets 207A or between the second set of Aramid-Fiber sheets 207B and the first backer board 209. The metallic mesh can be attached to either the first set of Aramid-Fiber sheets 207A or second set of Aramid-Fiber sheets 207B by either manual screws or equivalent fasteners or an adhesive fastening system. Alternatively, the metallic mesh may be installed between other layers of the antiballistic armored panel based on ease of construction, etc. The metallic mesh may be used for highly sensitive soundproof structures or areas within a structure and distorts and/or minimizes the effectiveness of listening devices. It is well known in the art of TEMPEST systems that grounding such a metallic mesh can provide shielding of electromagnetic signals.

The antiballistic armored panel assemblies 200 can be used as a load-bearing element in roofs, floors, and walls. Combinations of panel assemblies 200 may be screwed together to form a strong, lightweight building structure.

Figure 4:
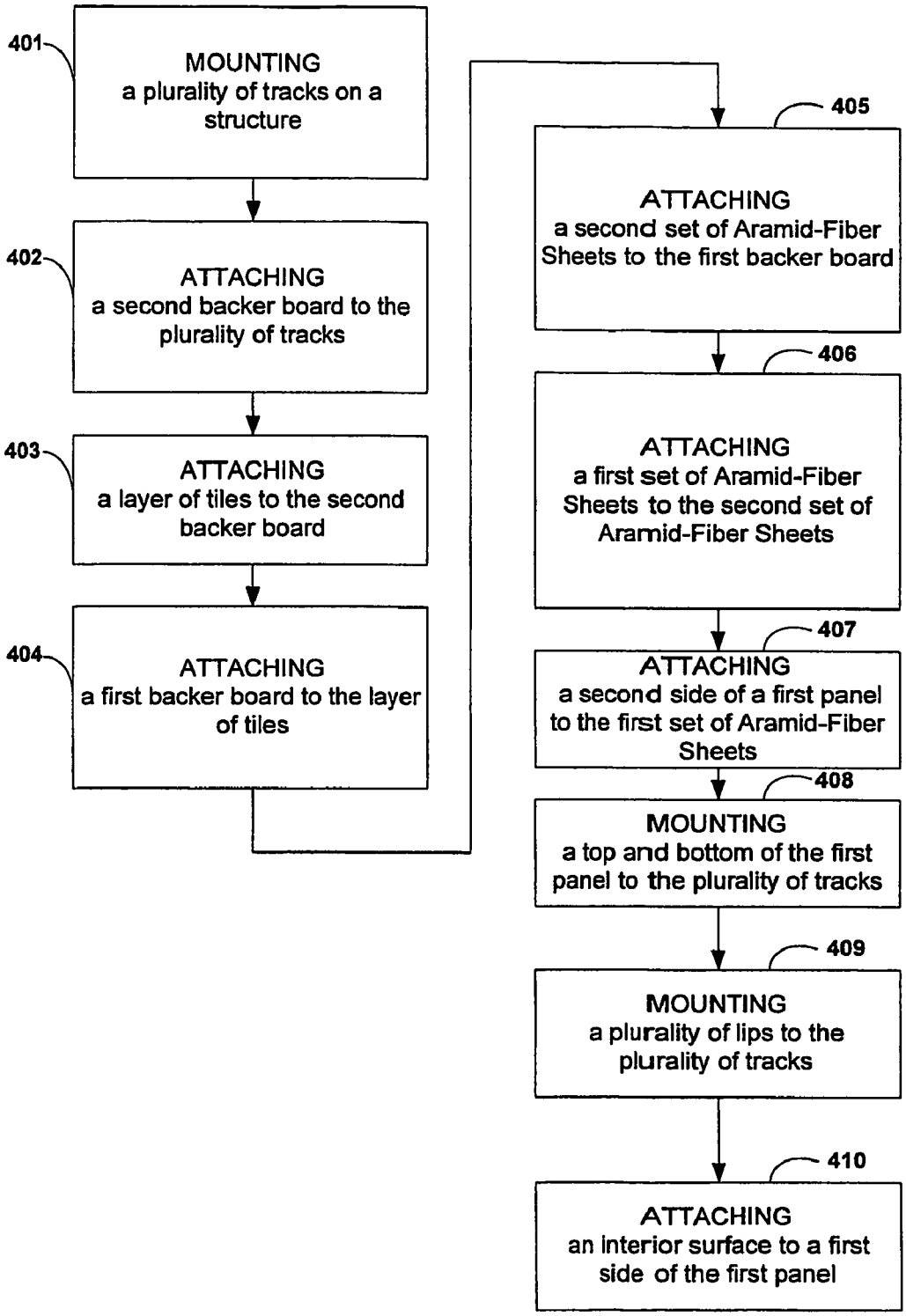
FIG. 4 is a flow diagram of the method for making the antiballistic interior armored wall assembly.

FIG. 4 is a flow diagram of the method for making the antiballistic interior armored wall assembly 200. Step 401 of FIG. 4 involves mounting a plurality of tracks on a structure. Attaching a second backer board to the plurality of tracks occurs in step 402. In step 403, a layer of tile is attached to the second backer board. Step 404 of FIG. 4 involves attaching a first backer board to the layer of tiles. Attaching a second set of Aramid-Fiber sheets to the first backer board occurs in step 405. In step 406, a first set of Aramid-Fiber sheets is attached to the second set of Aramid-Fiber sheets. Step 407 of FIG. 4 involves attaching a second side of a first panel to the first set of Aramid-Fiber sheets. Mounting a top and bottom of the first panel to the plurality of tracks occurs in step 408. In step 409, a plurality of lips are mounted to the plurality of tracks. In step 410 of FIG. 4, an interior surface is attached to a first side of the first panel.

The ranges of measure, materials and types of elements discussed above for the apparatus of the antiballistic interior armored wall assembly 200 are also applicable to the method for making the antiballistic interior armored wall assembly 200.

EXAMPLE 1

The following example illustrates test results for one embodiment of the present invention conducted by Underwriters Laboratories Inc.

Two test panels of bullet resisting wall material rated for UL Level 8 and designated "Ballistic Armor Matrix (BAM)-8" was submitted for testing. The construction of the wall material was as follows:

⅝" gypsum board;

3½" THERMASTEEL® panel;

¼" cementous fiber board;

½" quarry tile;

¼" cementous fiber board;

9 layer rigid KEVLAR®, two panels overlapping (i.e., a total of 18 layers);

3½" THERMASTEEL® panel; and

⅝" gypsum board.

The ammunition used for the investigation was 150 grain (9.7 g) 7.62 mm rifle lead core full metal copper jacket, military ball, minimum velocity 2750 fps (838 mps). All tests were conducted at close range, approximately 15 ft (4.6 m), using the ammunition and weapon specified. The test samples were mounted, with ⅛" (3.2 mm) thick corrugated cardboard indicator panels placed approximately 18" (467 mm) behind the protected side of each test sample. During the test, each bullet velocity was monitored and recorded.

The sample was subjected to a 5-shot test. The 5-shot test consists of five shots placed in a square pattern that is 4½" by 4½" (114 mm) located in the center of the test sample. With this shot pattern, there shall be no penetration of the projectile through the test sample, nor spalling of the material on the protected side of the test sample, to the extent that fragments embed in or damage the cardboard indicators. The velocity of each bullet was recorded during the test.

Test panel number 1 was constructed as a central wall panel such that no seams in the KEVLAR® panels were provided in the UL Level 8 test pattern area. 5 shots were placed for the UL Level 8 rating in the approximate center of the test sample. Following the five shots, there was no penetration of the projectiles, nor spalling of material on the protected side of the test sample. Results of this test are acceptable for the UL Level 8 rating in accordance with UL 752.

Test panel number 2 was constructed as a panel with a seam at the center such that seams in the KEVLAR® panels were provided in the UL Level 8 test pattern area. That is, in such a manner that the first four shots of the pattern would impact on the seams. Five shots were placed as for the UL Level 8 rating in the approximate center of the test sample. Following the five shots, there was no penetration of the projectiles, nor spalling of material on the protected side of the test sample. Results of this test are acceptable for the UL Level 8 rating in accordance with UL 752. The results of both tests discussed above are summarized in Table 2 below.

TABLE 2

Ballistic Resistance Testing Results For BAM 8 (UL LEVEL 8)

| | | Ballistic Threat | | |
|---|---|---|---|---|
| Impact Location | Shots | Caliber | Velocities (fps) | Penetrations |
| Central Wall Panel | 1 | 7.62 mm, M80 | 2845 | 0 |
| | 2 | 7.62 mm, M80 | 2825 | 0 |
| | 3 | 7.62 mm, M80 | 2810 | 0 |
| | 4 | 7.62 mm, M80 | 2823 | 0 |
| | 5 | 7.62 mm, M80 | 2844 | 0 |
| Panel Seam | 1 | 7.62 mm, M80 | 2850 | 0 |
| | 2 | 7.62 mm, M80 | 2810 | 0 |
| | 3 | 7.62 mm, M80 | 2830 | 0 |
| | 4 | 7.62 mm, M80 | 2824 | 0 |
| | 5 | 7.62 mm, M80 | 1852 | 0 |

With no penetrations indicated during testing, the results shown in Table 2, clearly indicate the successful antiballistic performance of the BAM 8 configuration of the antiballistic armored wall panel under UL Level 8 requirements.

Figure 5:
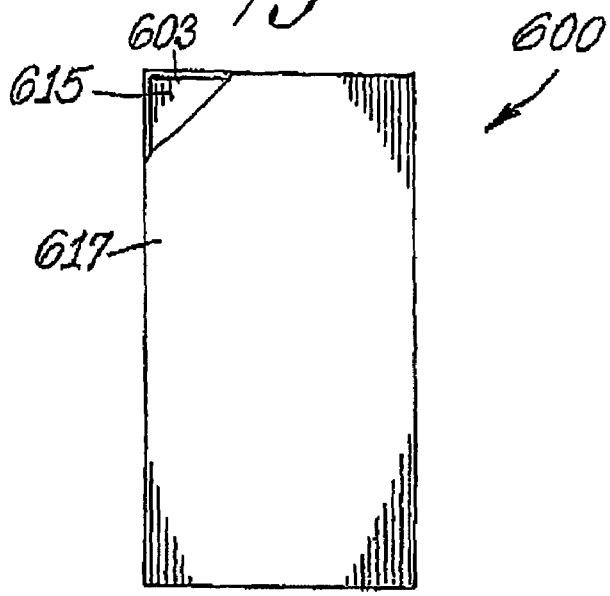
FIG. 5 is an end view of a portion of an interior or exterior antiballistic armored wall panel assembly.

FIG. 5 to FIG. 8 illustrates another embodiment of the present invention. FIG. 5 is an end view of a portion of an interior or exterior antiballistic armored wall panel assembly 600. FIG. 5 shows a plurality of tracks 605 that are mounted to a surface, a second panel 615, and an exterior surface 617. In addition, FIG. 5 comprises but does not show: a first panel 605, a first set of Aramid-Fiber sheets 607A, a second set of Aramid-Fiber sheets 607B, a first backer board 609, a layer of tiles 611 and a second backer board 613, and an interior surface 601 all of which precede the second panel 615.

Figure 6:
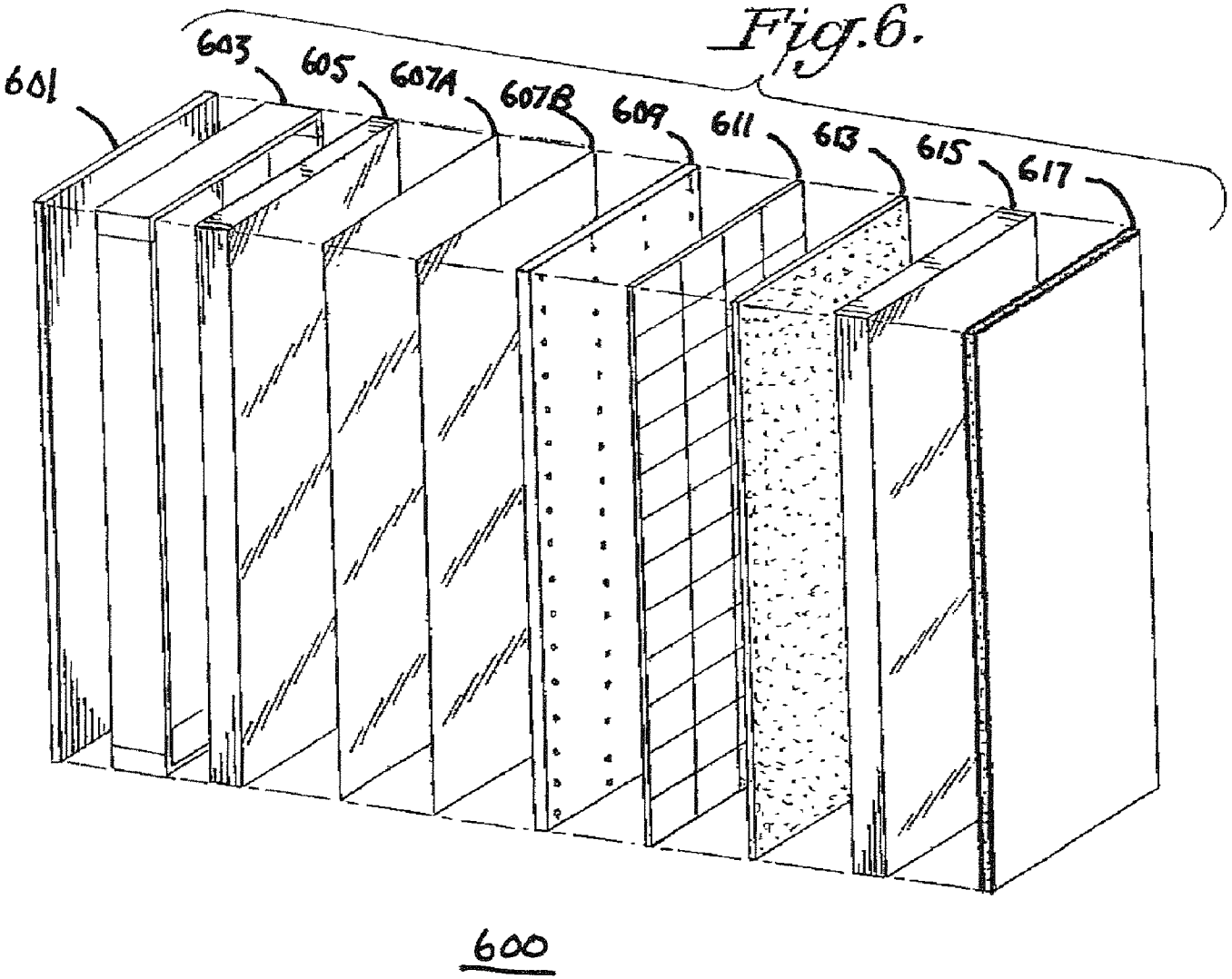
FIG. 6 illustrates an exploded perspective view of the interior antiballistic armored wall panel assembly.

FIG. 6 illustrates an exploded perspective view of the interior antiballistic armored wall panel assembly 600. FIG. 6 shows a configuration comprising: an interior surface 601, a plurality of tracks 603, a first panel 605, a first set of Aramid-Fiber sheets 607A, a second set of Aramid-Fiber sheets 607B, a first backer board 609, a layer of tiles 611, a second backer board 613, a second panel 615, a plurality of lips 625; and an exterior surface 617.

Figure 7:
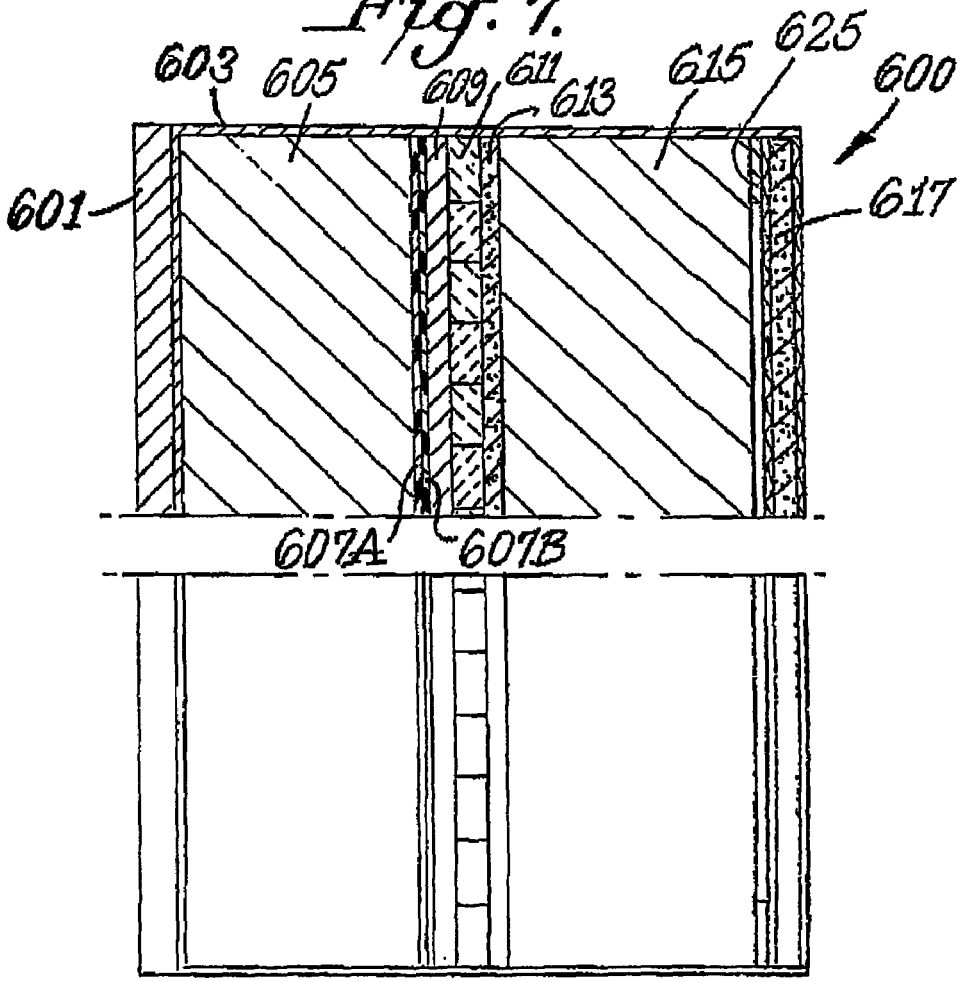
FIG. 7 illustrates a fragmental cross-sectional view of the interior antiballistic armored wall panel assembly.

FIG. 7 illustrates a fragmental cross-sectional view of the interior antiballistic armored wall panel assembly 600. FIG. 7 shows a configuration comprising: an interior surface 601, a plurality of tracks 603, a first panel 605, a first set of Aramid-Fiber sheets 607A, a second set of Aramid-Fiber sheets 607B, a first backer board 609, a layer of tiles 611, a second backer board 613, a second panel 615, a plurality of lips 625 and an exterior surface 617. In addition, FIG. 7 clearly illustrates the inner matrix comprising: the first set of Aramid-Fiber sheets 607A, the second set of Aramid-Fiber sheets 607B, the first backer board 609, the layer of tiles 611 and the second backer board 613.

The plurality of tracks 603 are used to contain and solidify the antiballistic armored panel assembly and provide structural integrity. As a non-limiting example, the plurality of tracks 603 can be made from sheet metal. Other materials, such as galvanized steel and mild steel, can also be used to form the plurality of tracks 603. The plurality of tracks 603 may have a non-limiting width of 3" and a length of 10". The plurality of tracks 603 can be attached to the first panel 605 and second panel 615 using, for example, self-tapping drill tip screws, equivalent fasteners or welding.

The first panel 605 and second panel 615 may be made, for example, from metals such as light gauge steel. A non-limiting example of such a light gauge steel is THERMASTEEL®, which is manufactured by THERMASTEEL Corp., Radford Va.

The first panel 605 and second panel 615 may have varying thicknesses depending upon the desired application. As a non-limiting example, the first panel 605 and second panel 615 may have a thickness in the range of about 3½"-7½". The first panel 605 and second panel 615 provide a structural, sound-diminishing, insulated, and lightweight carrier for the inner matrix discussed above.

In addition, the first panel 605 and second panel 615 may be insulated. Insulation in the first panel 205 and second panel 615 may have the form of a rigid, fire-retardant modified expanded polystyrene resin (EPS) bonded to the steel.

The first panel 605 and second panel 615 may be used as load-bearing portions of a steel frame structure. Therefore, the interior or exterior antiballistic armored panel 600 can be used as a load-bearing element in roofs, floors, and walls.

Figure 8:
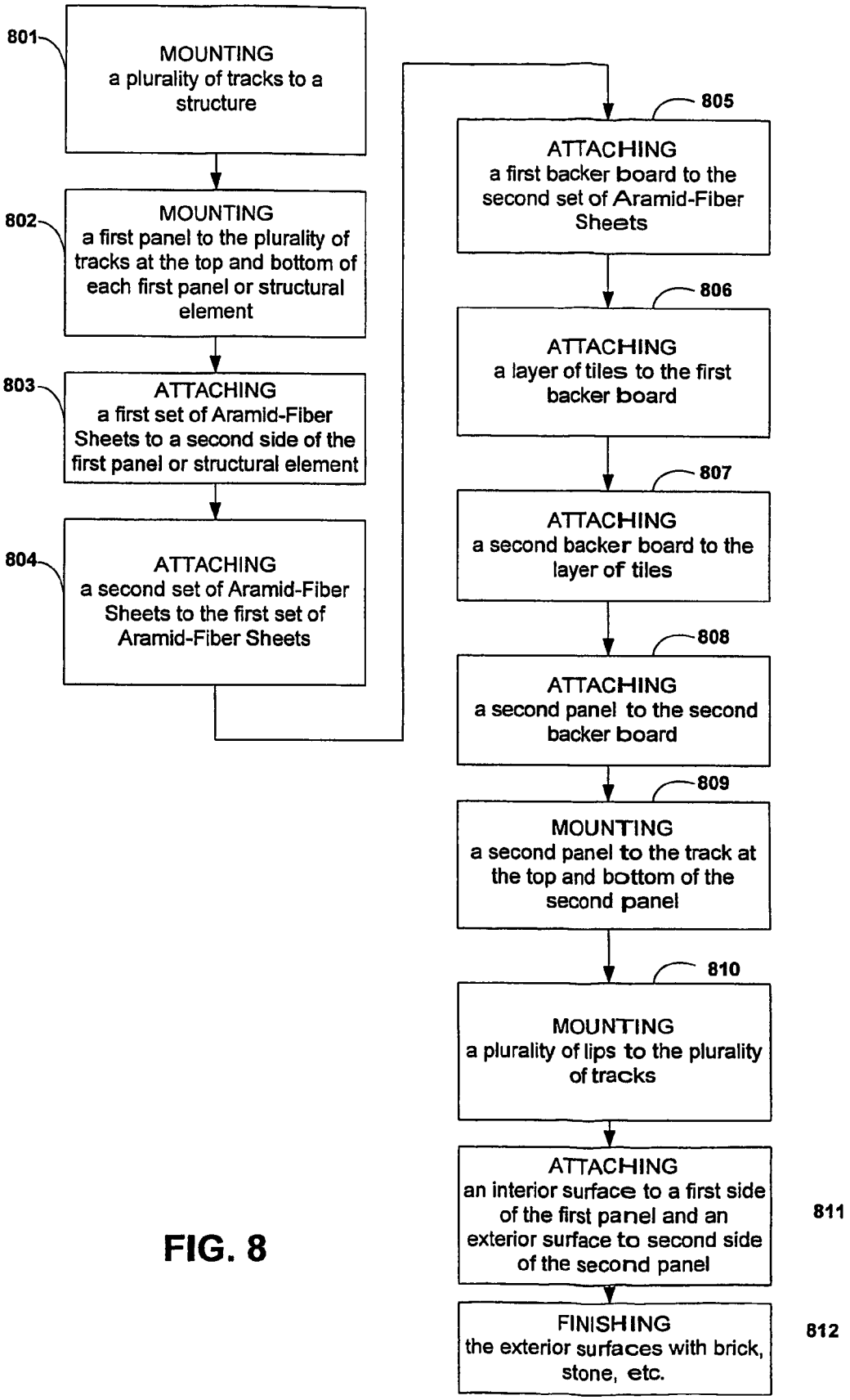
FIG. 8 is a flow diagram of the method for making the antiballistic interior and exterior armored wall assembly.

FIG. 8 is a flow diagram of the method for making the antiballistic interior and exterior armored wall assembly 600. Step 801 of FIG. 8 involves mounting a plurality of tracks on a structure. Mounting a top and bottom of a first panel on the plurality of tracks occurs in step 802. In step 803, a second side of the first panel is attached to a first set of Aramid-Fiber sheets. Step 804 of FIG. 8 involves attaching the first set of Aramid-Fiber sheets to a second set of Aramid-Fiber sheets. Attaching a first backer board to the second set of Aramid-Fiber sheets occurs in step 805. In step 806, the first backer board is attached to a layer of tiles. Step 807 of FIG. 8 involves attaching a second backer board to the layer of tiles. Attaching a second panel to the second backer board occurs in step 808. Step 809 of FIG. 8 involves mounting a top and bottom of the second panel to the plurality of tracks. In step 810, a plurality of lips are mounted to the plurality of tracks. In step 811, an interior surface is attached to a first side of the first panel and an exterior surface is attached to a second side of the second panel. Finishing the exterior surface with brick, stone other external finishing materials occurs in step 812.

The ranges of measure, materials and types of elements discussed above for the apparatus of the interior antiballistic armored wall assembly 200 are also applicable to the method for making the antiballistic interior armored wall assembly 600.

EXAMPLE 2

The following example illustrates test results for one embodiment of the present invention conducted by Antiballistic Security and Protection (ASAP), Inc.

A test panel of antiballistic armored wall panel material, designated as "BAM-1," was submitted for testing. The construction of the antiballistic interior or exterior armored wall panel comprised the following materials:

⅝" gypsum board;

3½" THERMASTEEL® panel;

5/16" cementous fiber board;

½" quarry tile;

5/16" cementous fiber board;

4 layer rigid KEVLAR®, two panels overlapping (i.e., a total of 8 layers);

3½" THERMASTEEL® panel; and

⅝" gypsum board.

The ammunition used for the investigation was 149 grain, 7.62 mm rifle lead core full metal copper jacket, military ball, minimum velocity 3000 fps. All tests were conducted at close range, approximately 45 ft (13.8 m), using the ammunition specified and a 30/06 rifle.

The sample was subjected to a 5-shot test. For a successful test, there shall be no penetration of the projectile through the test sample, nor spalling of the material on the protected side of the test sample, to the extent that fragments embed in or damage the cardboard indicators. The velocity of each bullet was recorded during the test.

TABLE 3

Ballistic Resistance Testing Results For BAM 1 (UL LEVEL 8)

| | | Ballistic Threat | | |
|---|---|---|---|---|
| Impact Location | Shots | Caliber | Velocities (fps) | Penetrations |
| Upper Left | 1 | 7.62 mm, M80 | 3000 | 0 |
| Upper Right | 2 | 7.62 mm, M80 | 3000 | 0 |
| Lower Right | 3 | 7.62 mm, M80 | 3000 | 0 |
| Lower Left | 4 | 7.62 mm, M80 | 3000 | 0 |
| Center | 5 | 7.62 mm, M80 | 3000 | 0 |

With no penetrations indicated during testing, the results shown in Table 3, clearly indicate the successful antiballistic performance of the BAM 1 configuration of the antiballistic armored wall panel under UL Level 8 requirements.

Figure 9:
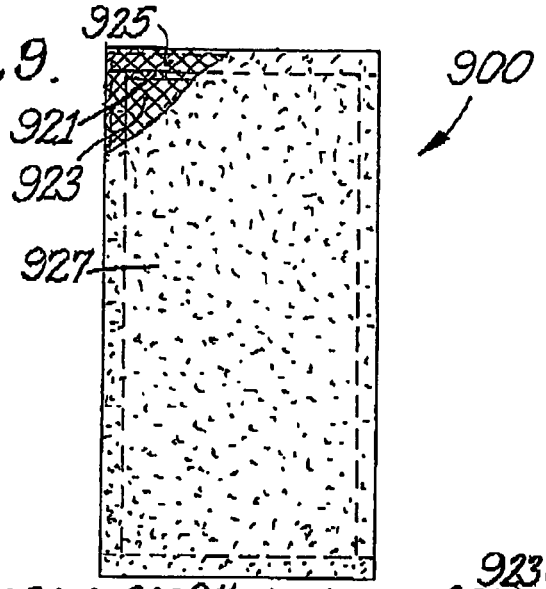
FIG. 9 is an end view of a portion of an antiballistic/anti-forced entry interior or exterior armored wall panel assembly.

FIG. 9 to FIG. 12 illustrates yet another embodiment of the present invention. FIG. 9 is an end view of a portion of an antiballistic/anti-forced entry interior or exterior armored wall panel assembly 900. FIG. 9 shows a second panel 915, a hardened steel mesh 919, at least one of horizontal rebars, spacers and fasteners 921, stucco mesh 923, an exterior track frame 925 and a stucco surface 927. In addition, FIG. 9 comprises but does not show: a first panel 905, a first set of Aramid-Fiber sheets 907A, a second set of Aramid-Fiber sheets 907B, a first backer board 909, a layer of tiles 911 and a second backer board 913, and an interior surface 901 all of which precedes the second panel 915.

Figure 10:
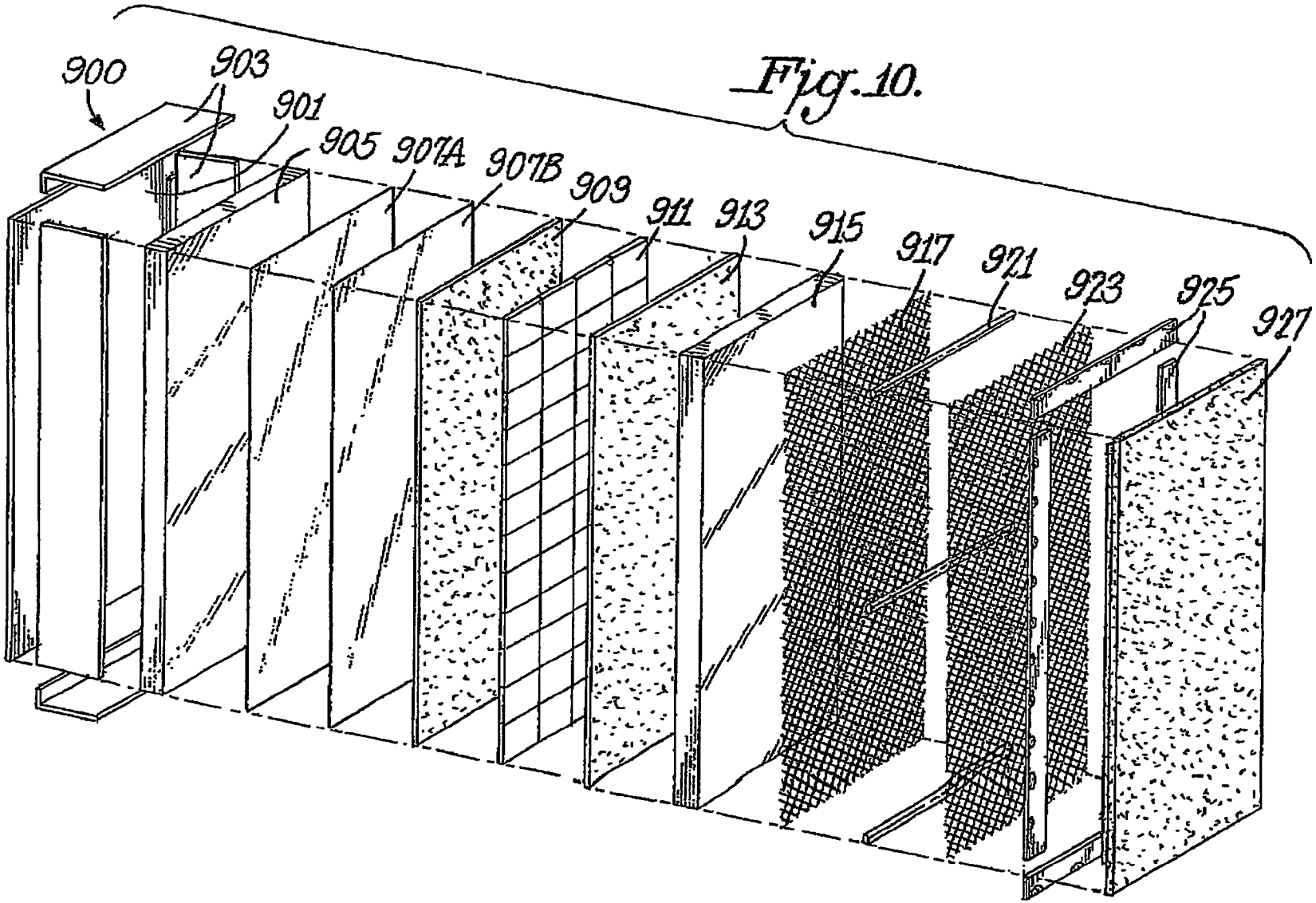
FIG. 10 illustrates an exploded perspective view of the antiballistic/anti-forced interior or exterior armored wall assembly.

FIG. 10 illustrates an exploded perspective view of the antiballistic/anti-forced interior or exterior armored wall assembly 900. FIG. 10 shows a configuration comprising: an interior surface 901, a plurality of tracks 903, a first panel 905, a first set of Aramid-Fiber sheets 907A, a second set of Aramid-Fiber sheets 907B, a first backer board 909, a layer of tiles 911, a second backer board 913, a second panel 915, a hardened steel mesh 919, horizontal rebars 921, a stucco mesh 923, an exterior track frame 925 formed from a plurality of lips and a stucco surface 927.

Figure 11:
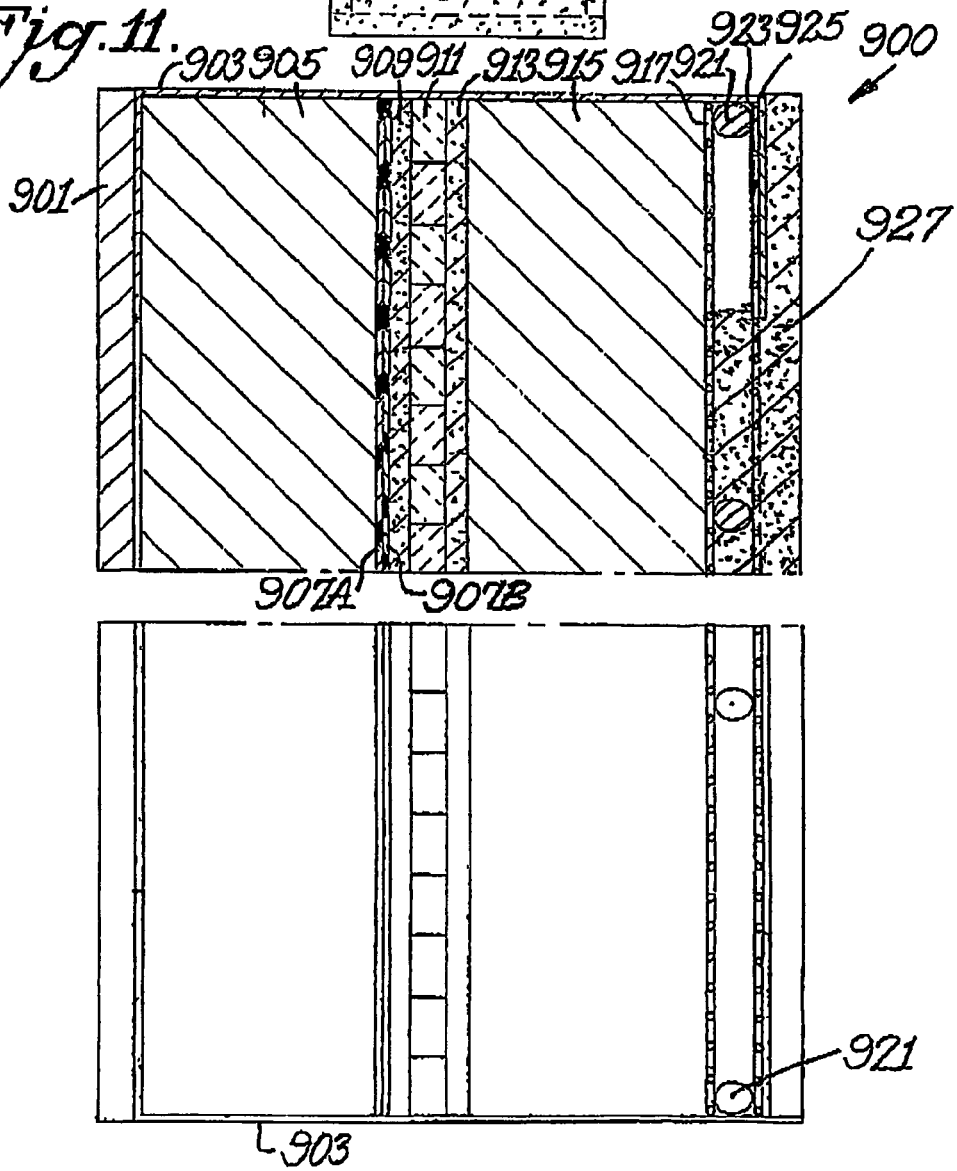
FIG. 11 illustrates a fragmental cross-sectional view of the antiballistic/anti-forced interior or exterior armored wall assembly.

FIG. 11 illustrates a fragmental cross-sectional view of the antiballistic/anti-forced interior or exterior armored wall assembly 900. FIG. 11 shows a configuration comprising: an interior surface 901, a plurality of tracks 903, a first panel 905, a first set of Aramid-Fiber sheets 907A, a second set of Aramid-Fiber sheets 907B, a first backer board 909, a tile layer 911, a second backer board 913, a second panel 915, and an exterior surface 917. In addition, FIG. 11 clearly illustrates the inner matrix comprising: the first set of Aramid-Fiber sheets 907A, the second set of Aramid-Fiber sheets 907B, the first backer board 909, the layer of tiles 911 and the second backer board 913.

The plurality of tracks 903 are used to contain and solidify the antiballistic armored panel assembly and provide structural integrity. As a non-limiting example, the plurality of tracks 903 can be made from sheet metal. Other materials, such as galvanized steel and mild steel, can also be used to form the plurality of tracks 903. The plurality of tracks 903 can be attached to the first panel 905 and second panel 915 using, for example, self-tapping drill tip screws, equivalent fasteners or welding.

The first panel 905 and second panel 915 may be made, for example, from metals such as light gauge steel. A non-limiting example of such a light gauge steel is THERMASTEEL®, which is manufactured by THERMASTEEL Corp., Radford Va.

The first panel 905 and second panel 915 may have varying thicknesses depending upon the desired application. As a non-limiting example, the first panel 905 and second panel 915 may have a thickness in the range of about 3½"-7½". The first panel 905 and second panel 915 provide a structural, sound-diminishing, insulated, and lightweight carrier for the inner matrix discussed above.

In addition, the first panel 905 and second panel 915 may be insulated. Insulation in the first panel 905 and second panel 915 may have the form of a rigid, fire-retardant modified expanded polystyrene resin (EPS) bonded to the steel.

The first panel 905 and second panel 915 may be used as load-bearing portions of a steel frame structure. Therefore, the interior or exterior antiballistic armored panel 900 can be used as a load-bearing element in roofs, floors, and walls.

A non-limiting example of the hardened steel mesh 919 is an AMICO Secure Fence System. A non-limiting example of a stucco mesh 923 is a layer of AMICO Secura Lath. Further, a non-limiting examples of material for finishing the stucco mesh 923 is a layer of STO High Strength, Exterior Stucco. Furthermore, non-limiting examples of material for finishing exterior surface 917 include brick, stone, etc.

The ranges of measure, materials and types of elements discussed above for the apparatus of the antiballistic armored wall assemblies 200, 600 are also applicable to the method for making the antiballistic/anti-forced entry interior or exterior armored wall assembly 900.

Figure 12:
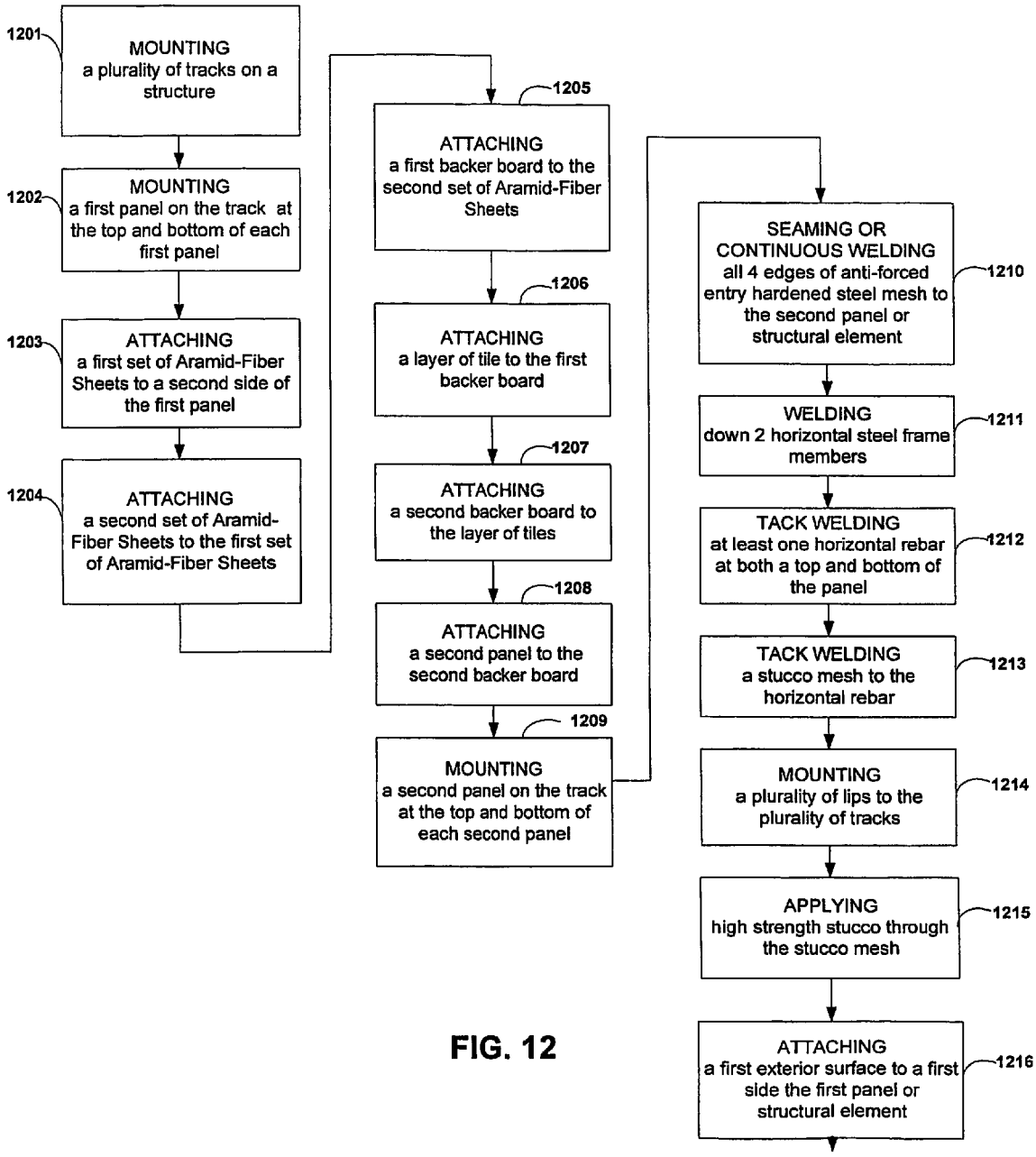
FIG. 12 is a flow diagram of the method for making the antiballistic interior and exterior armored wall assembly.

FIG. 12 is a flow diagram of the method for making the antiballistic interior and exterior armored wall assembly 900. Step 1201 of FIG. 12 involves mounting a plurality of tracks on a structure. Mounting a top and bottom of the first panel on the plurality of tracks occurs in step 1202. In step 1203, a first set of Aramid-Fiber sheets is attached to the second side of the first panel. Step 1204 of FIG. 12 involves attaching a second set of Aramid-Fiber sheets to the first set of Aramid-Fiber sheets. In step 1205, a first backer board is attached to the second set of Aramid-Fiber sheets. Step 1206 of FIG. 12 involves attaching a layer of tiles to the first backer board. Attaching a second backer board to the layer of tiles occurs in step 1207. Step 1208 of FIG. 12 involves attaching a second panel to the second backer board. Step 1209 involves mounting a top and bottom of the second panel to the track. In step 1210, all 4 edges of anti-forced entry hardened steel mesh is seamed or continuously welded to a second side of the second panel or steel stud structural element. Step 1211 involves welding down two (2) horizontal steel frame members to the hardened steel mesh. Tack welding at least one horizontal rebar at both a top and bottom the second panel occurs in step 1212. Step 1213 of FIG. 12 involves tack welding a stucco mesh to the horizontal rebar. In step 1214, a plurality of lips are mounted to the plurality of tracks at intervals equally spaced along edges of the second panel. Applying high strength stucco through the stucco mesh occurs in step 1215. In step 1216 of FIG. 12, an interior surface is attached to a first side of the first panel.

EXAMPLE 3

The following example illustrates test results for one embodiment of the present invention conducted by the United States Department of State.

Two test panels of bullet resisting armored wall panel material and designated "BAM-1A" was submitted for testing. The construction of the armored wall panel material was as follows:

⅝" gypsum board;
3½" THERMASTEEL® panel;
4 layer rigid KEVLAR®, two panels overlapping (i.e., a total of 8 layers);
5/16" cementous fiber board;
½" quarry tile;
5/16" cementous fiber board;
3½" THERMASTEEL® panel;
hardened steel mesh;
horizontal steel frame members;
horizontal rebar;
stucco mesh; and
stucco.

The armored wall panels submitted for testing consisted of two nominal 4'×8' panels joined together and were approximately 96" square by 10¾" thick. The protected side of the panel was covered with standard ⅝" gypsum board. The entire unit was framed in a 10 gauge galvanized channel. Mounting brackets of 4" angle iron were attached to the sides.

The armored wall panels were tested for a Rifle level of ballistic resistance and a 15 Minute level of forced entry protection. Except as noted, both tests were in accordance with procedures of SD-STD-01.01, Revision G [Amended], dated Apr. 30, 1993.

In particular, the Ballistic Resistance Testing was conducted in accordance with provisions of Paragraphs 2.4.1, 2.4.2, 2.6.1, 2.7, 3.2, 3.4.1 and Tables I and IV of SD-STD-01.01, Revision G [Amended]. Testing the mounting gap was not applicable. The results of the testing are summarized in Table 4.

TABLE 4

Ballistic Resistance Testing Results For BAM 1A

| | | Ballistic Threat | | Penetra- |
|---|---|---|---|---|
| Impact Location | Shots | Caliber | Velocities (fps) | tions |
| Central Wall | 1 | 7.62 mm, M80 | 2790 | 0 |
| Panel | 1 | 5.66 mm, M193 | 3256 | 0 |
| | 1 | 5.66 mm, M855 | 3029 | 0 |
| Panel Seam | 1 | 7.62 mm, M80 | 2797 | 0 |
| | 1 | 5.56 mm, M193 | 3249 | 0 |
| | 1 | 5.56, M855 | 3037 | 0 |

With no penetrations indicated during testing, the results shown in Table 4, clearly indicate the successful antiballistic performance of the BAM 1A configuration of the antiballistic and anti-forced entry armored wall panel.

In particular, the Forced Entry Testing was conducted in accordance with provisions of Paragraphs 2.3.2, 2.6.2, 3.3.3.4.2 and Tables II and III of SD-STD-011.01, Revision G [Amended]. Four 15 minute concentrated assaults were planned on the central panel of the armored wall panel. The results of the testing are summarized in Table 5.

TABLE 5

Forced Entry Resistance Testing Results For BAM-1A

| Portion Tested | Paragraph[1] | Tools Used for Entry Testing | Time (minutes) | Entry Forced |
|---|---|---|---|---|
| Central Wall Panel | 3.3.2 | Sledgehammers, Wood Axe, Pry Bars, Hack Saws | 15:00 | 0 |
| Panel Seam | 3.3.2 | Sledgehammers, Wood Axe, Pry Bars, Crow Bars, Hack Saws | 15:00 | 0 |

[1]-SD-STD-0.1.01, Revision G [Amended].

With no forced entries indicated during testing, the results shown in Table 5, clearly indicate the successful anti-forced entry performance on the 15 Minute Test of the DAM 1A configuration of the antiballistic and anti-forced entry armored wall panel. In addition, preliminary results for the "60 Minute Test" for forced entry on the BAM 1A configuration has also produced promising test data.

EXAMPLE 4

Figure 13A:
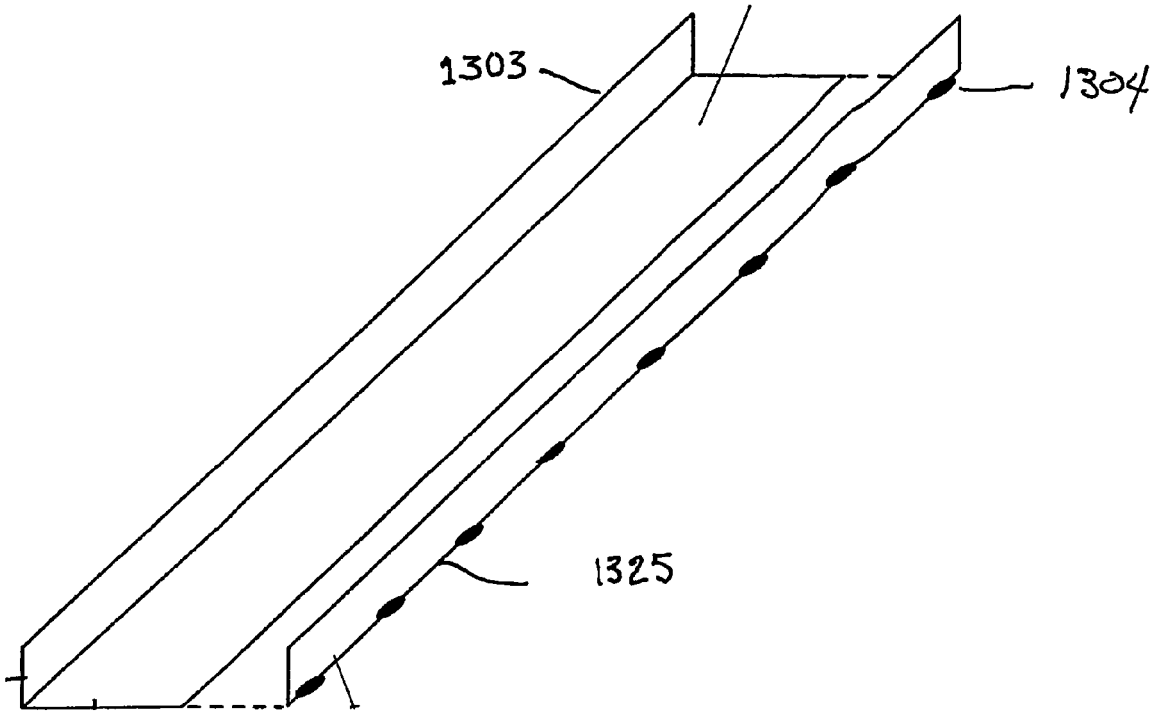
FIGS. 13A-13N illustrates an exemplary apparatus and method for assembling an antiballistic and anti-forced entry armored panel.
Figure 13B:
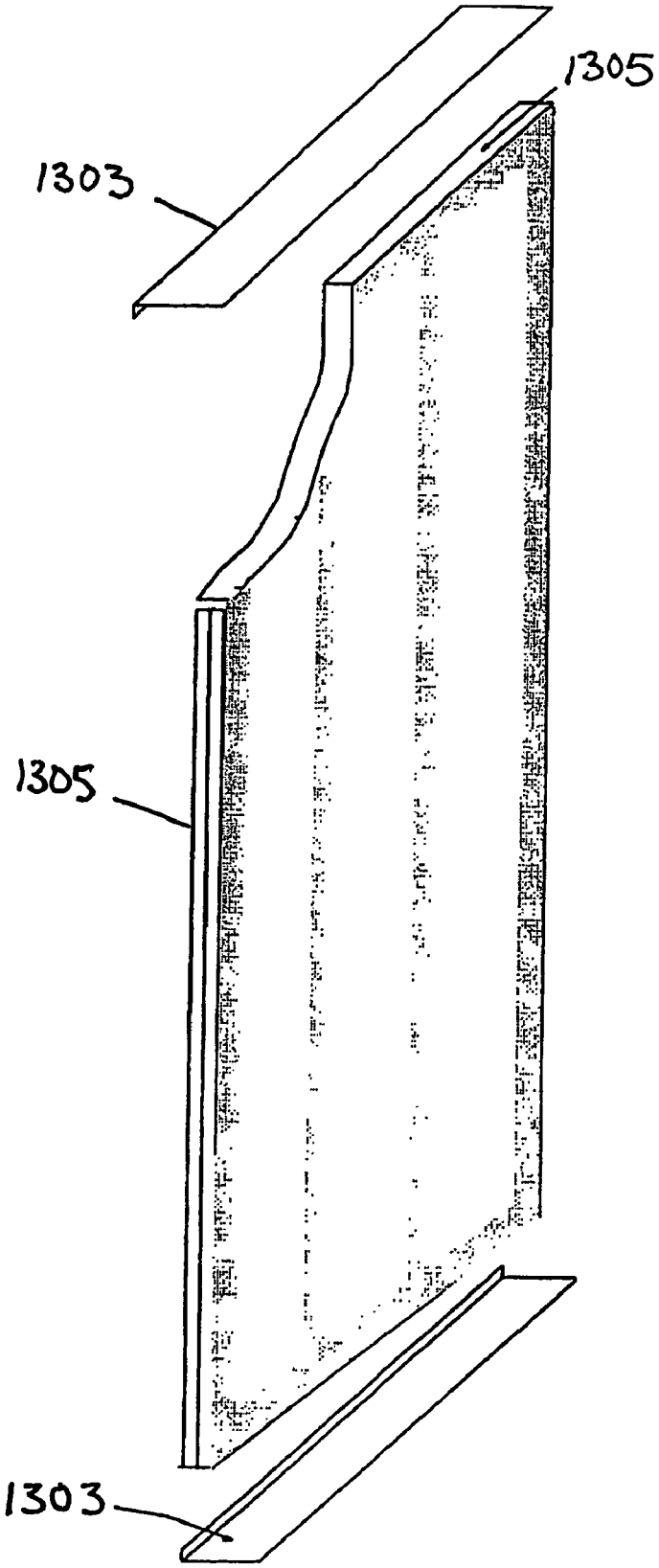
Figure 13C:
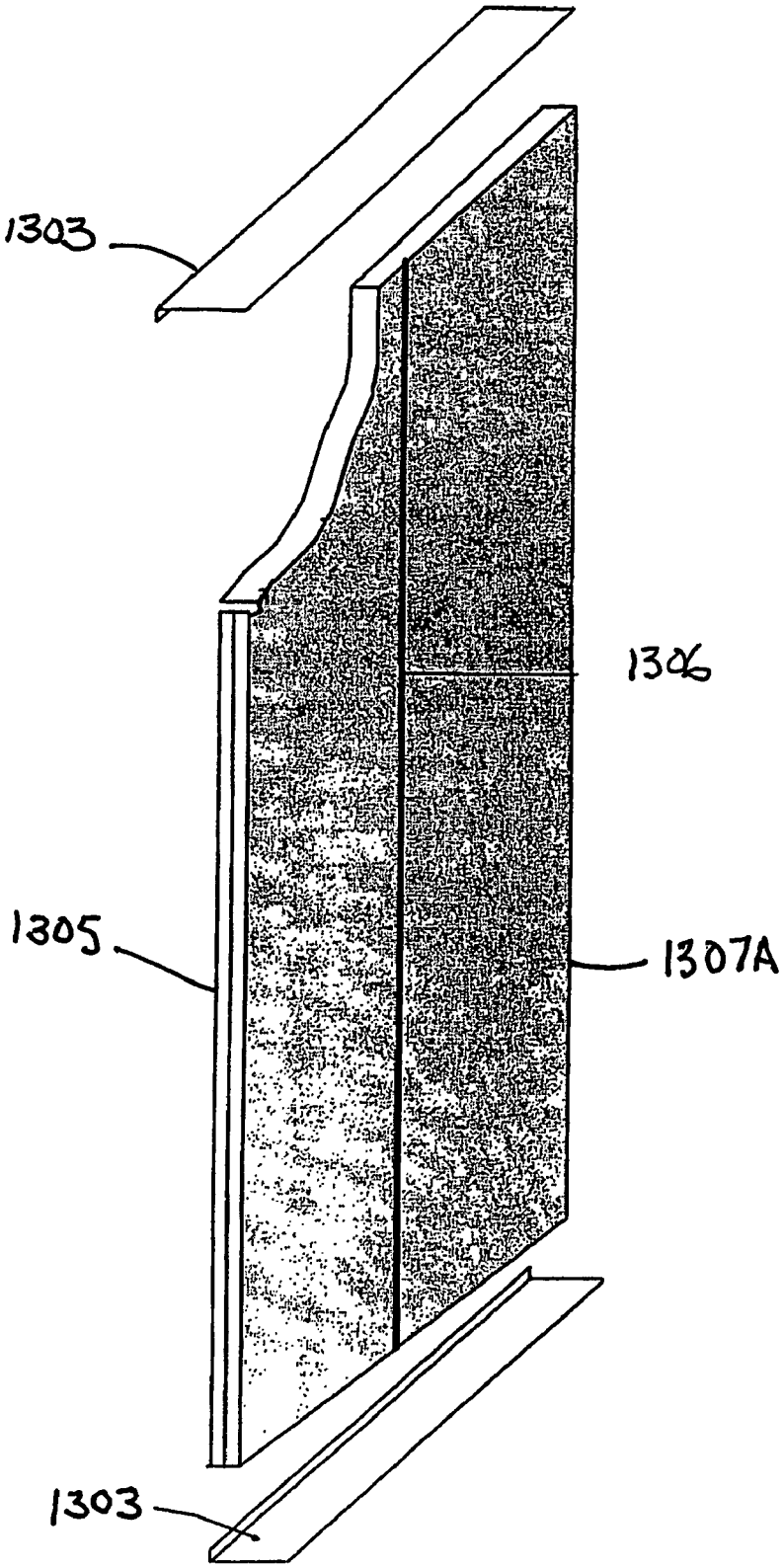
Figure 13D:
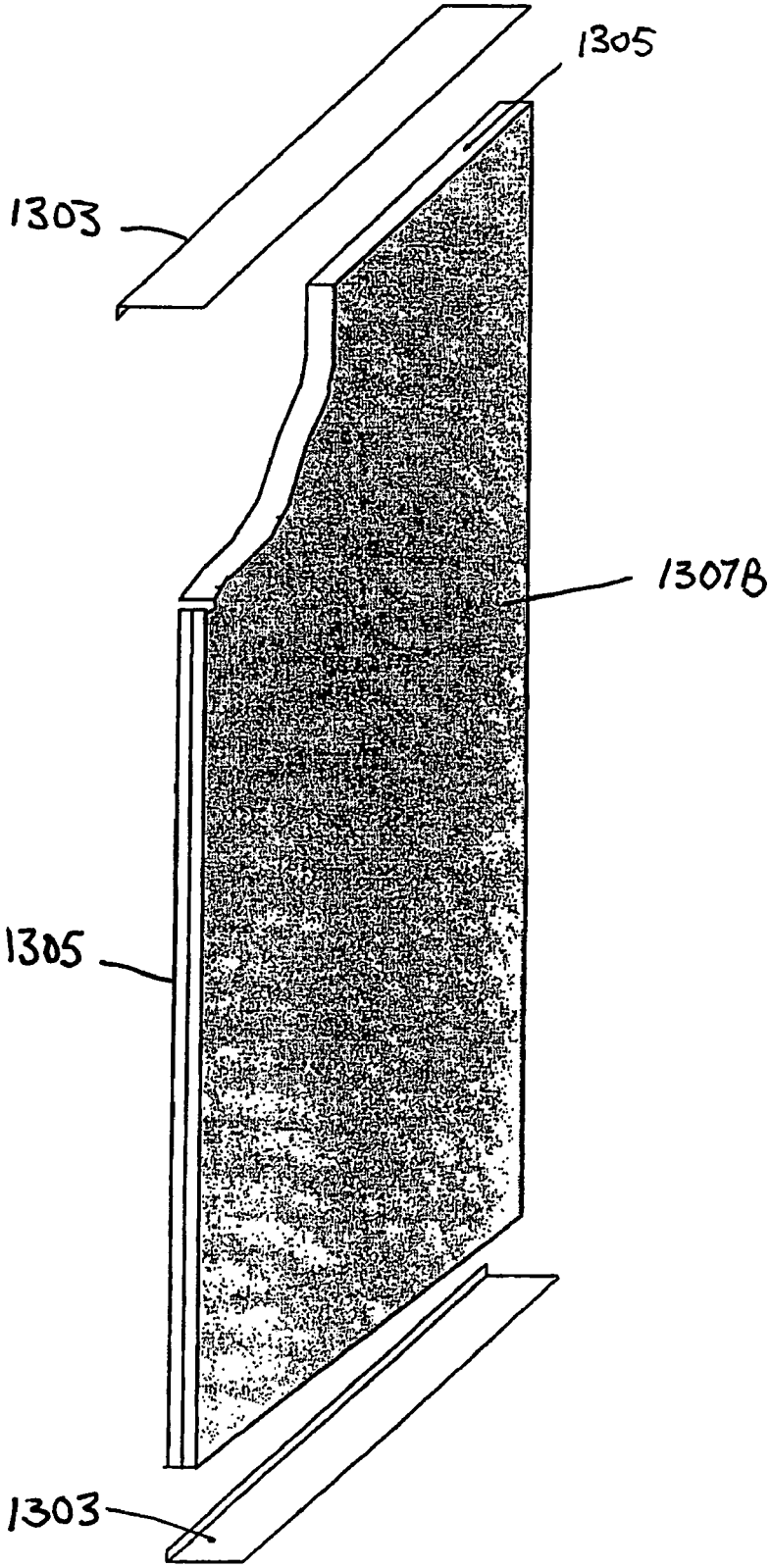
Figure 13E:
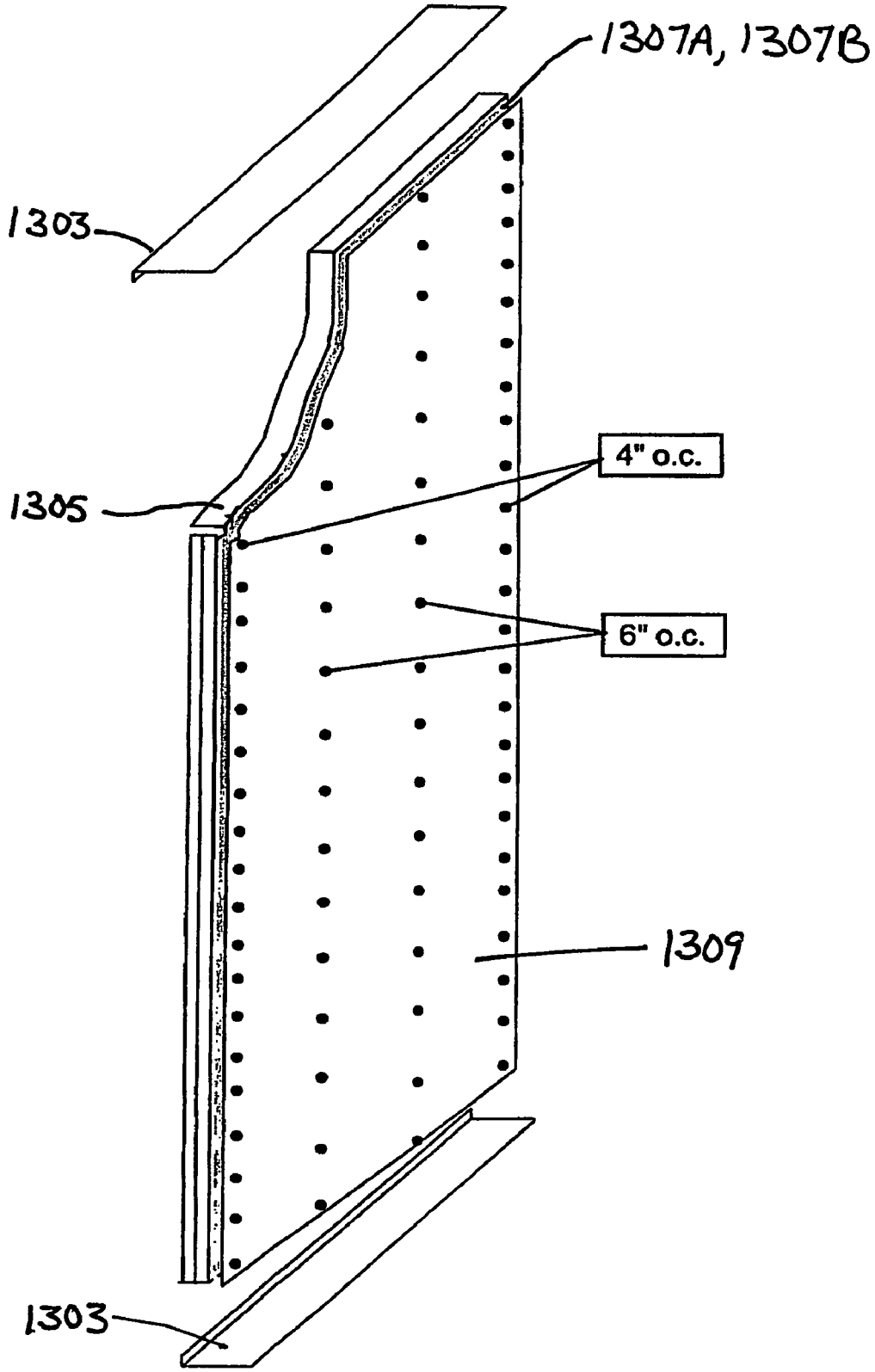
Figure 13F:
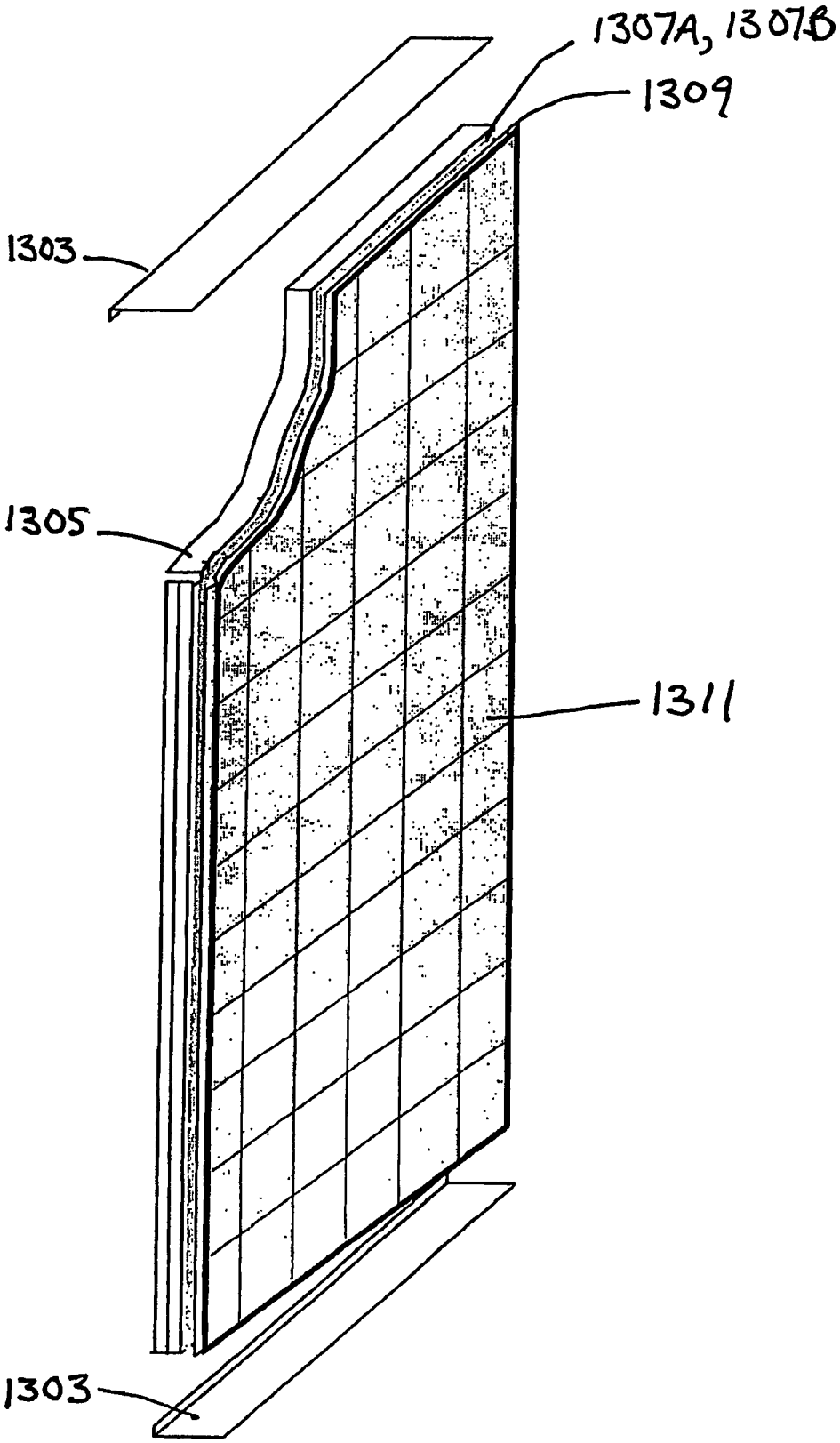
Figure 13G:
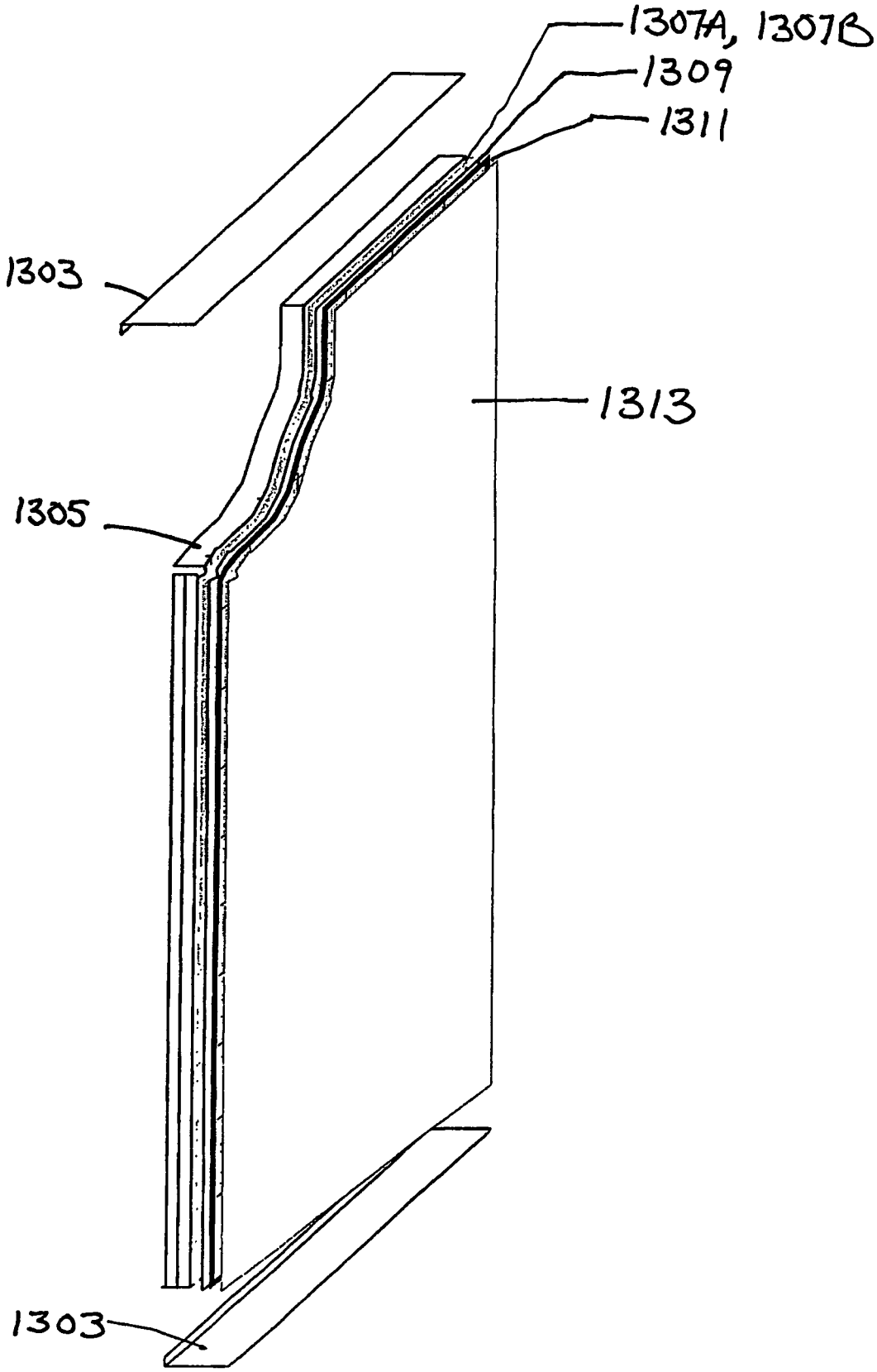
Figure 13H:
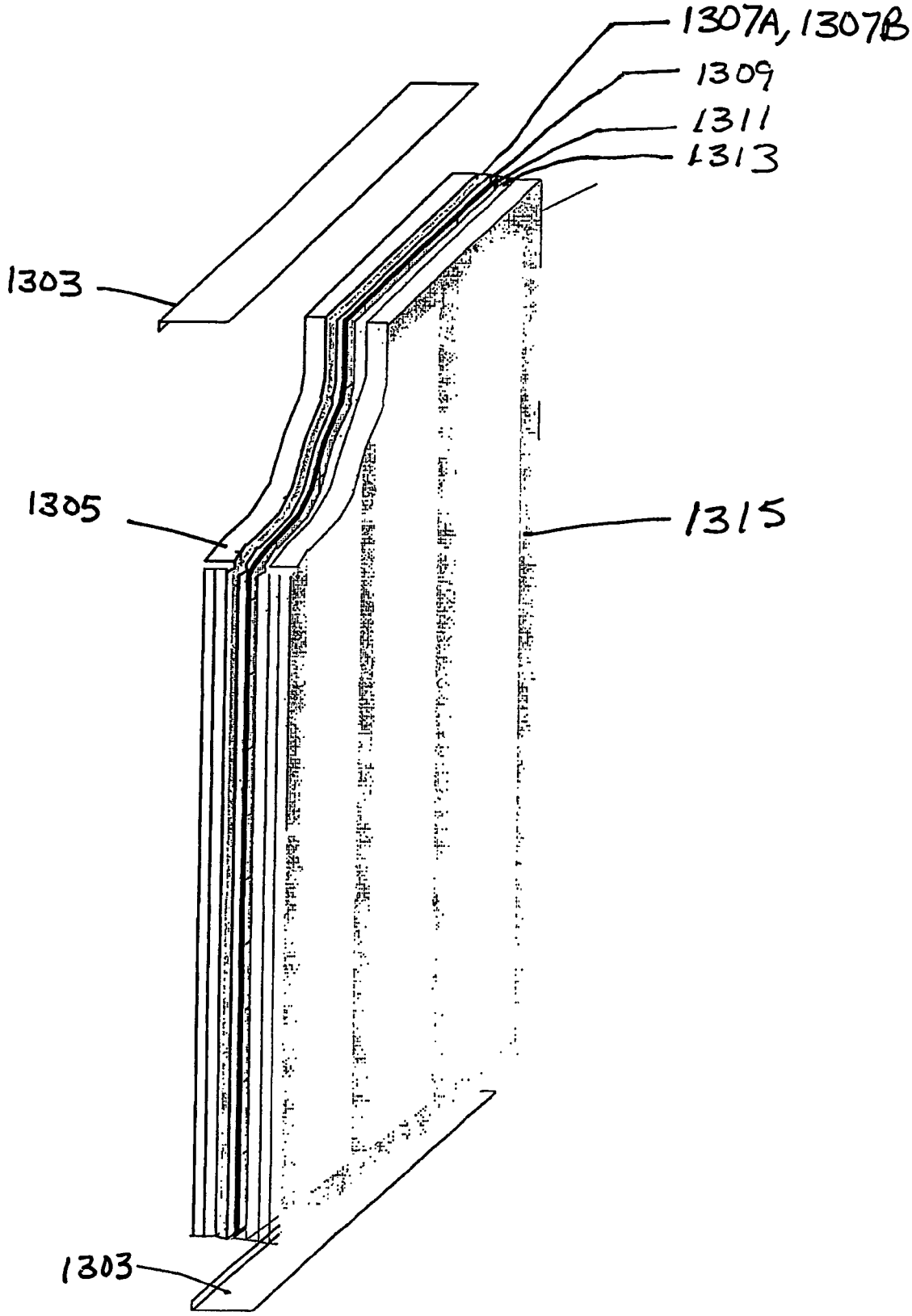
Figure 13I:
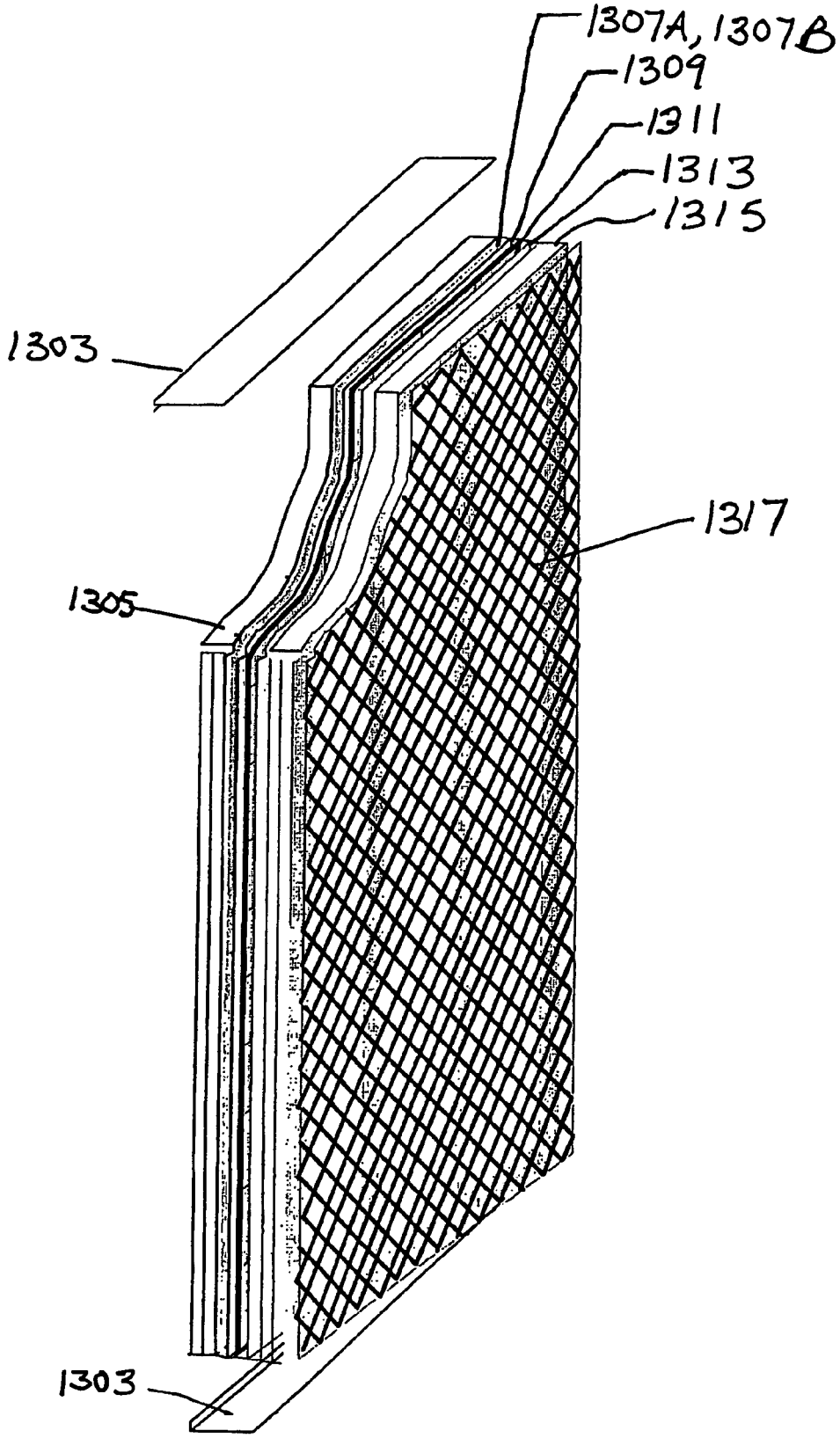
Figure 13J:
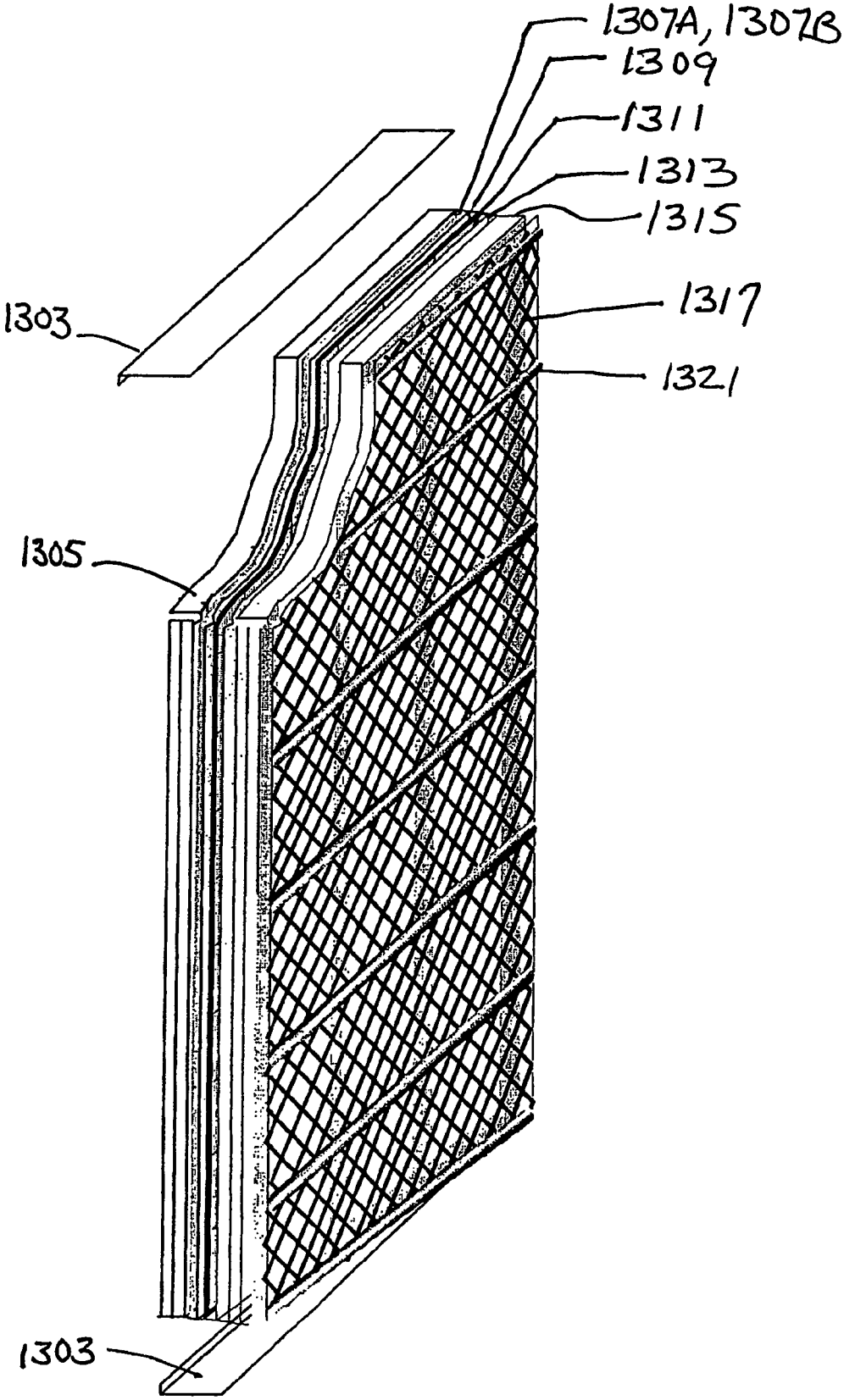
Figure 13K:
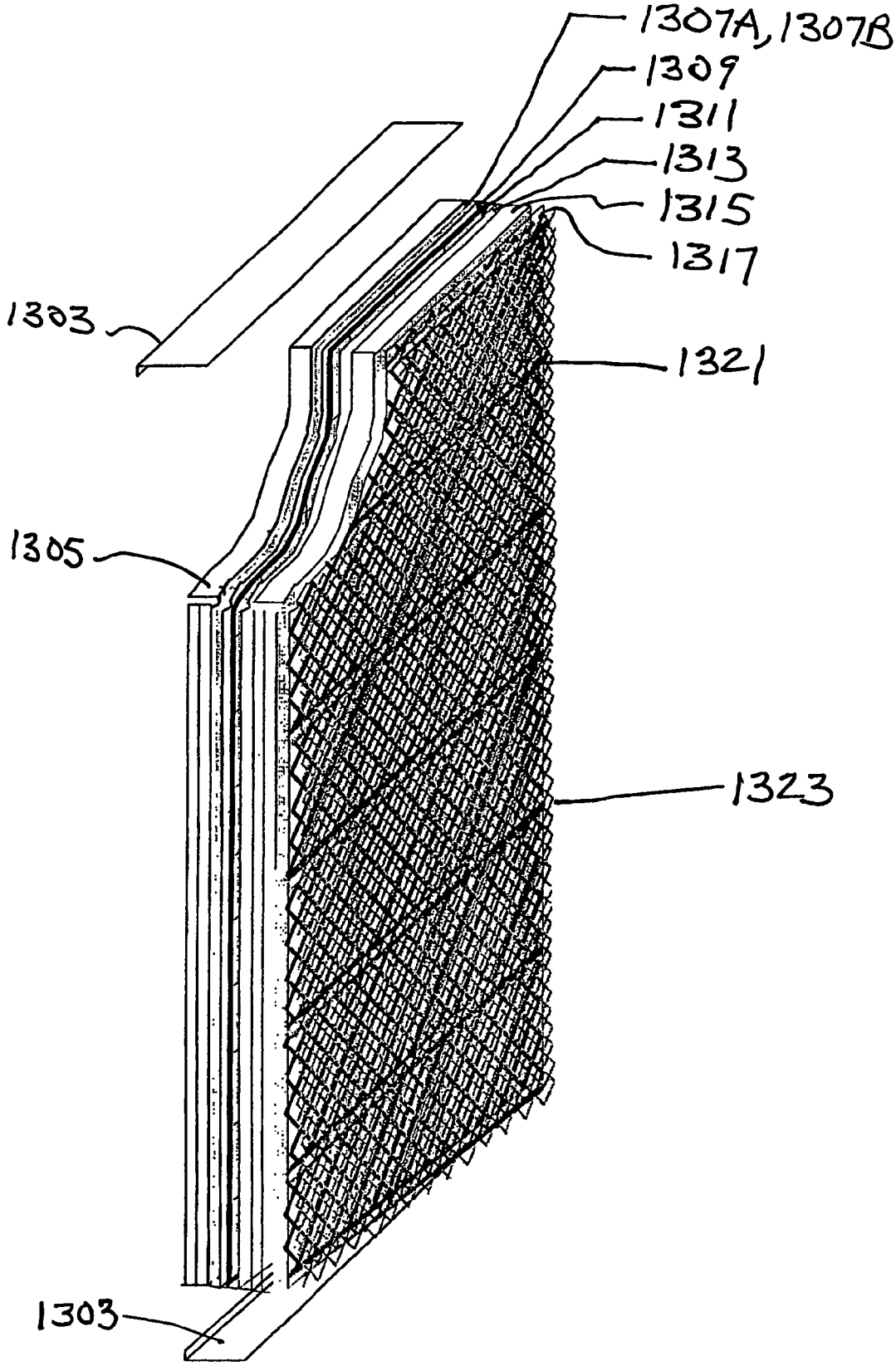
Figure 13L:
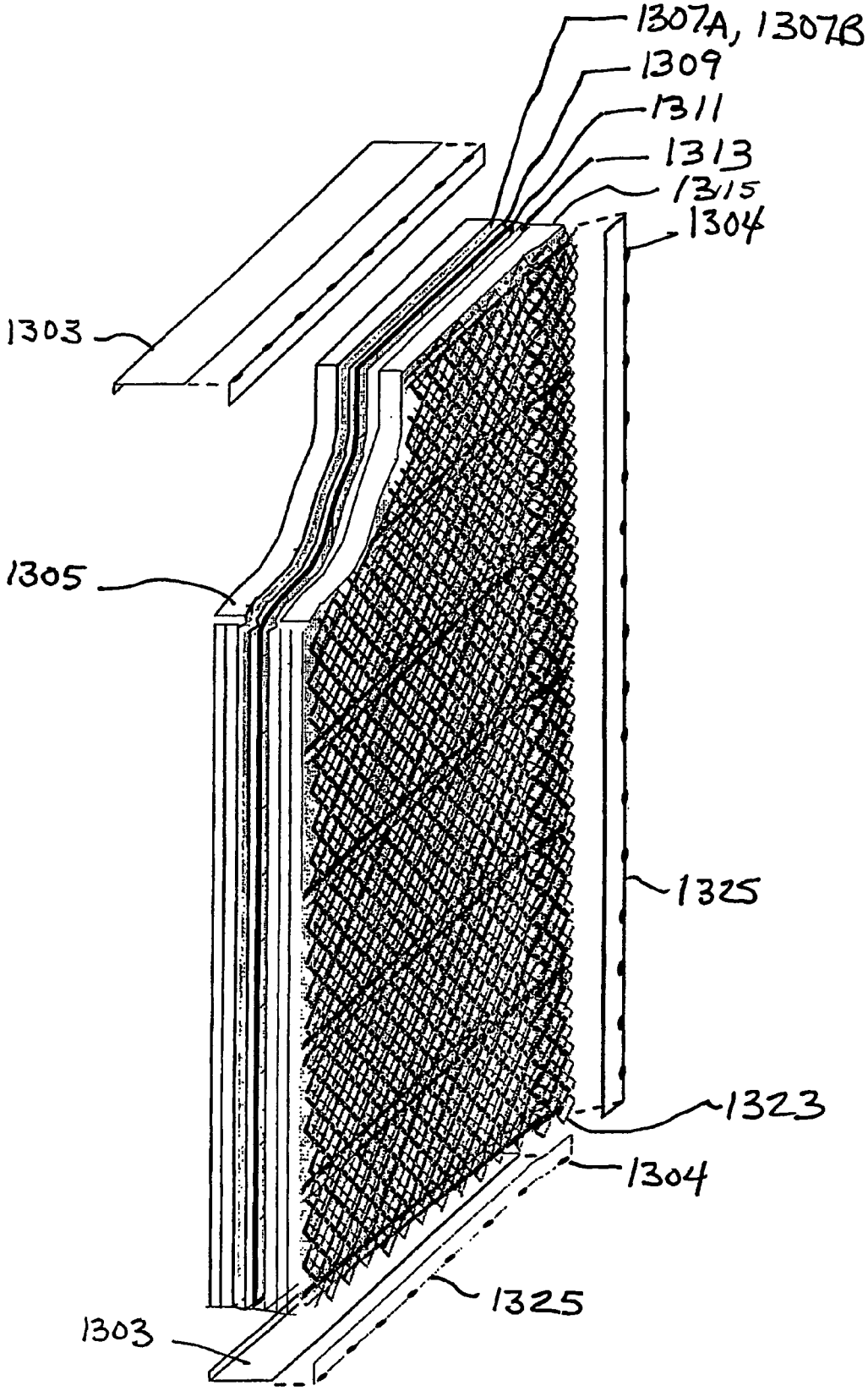
Figure 13M:
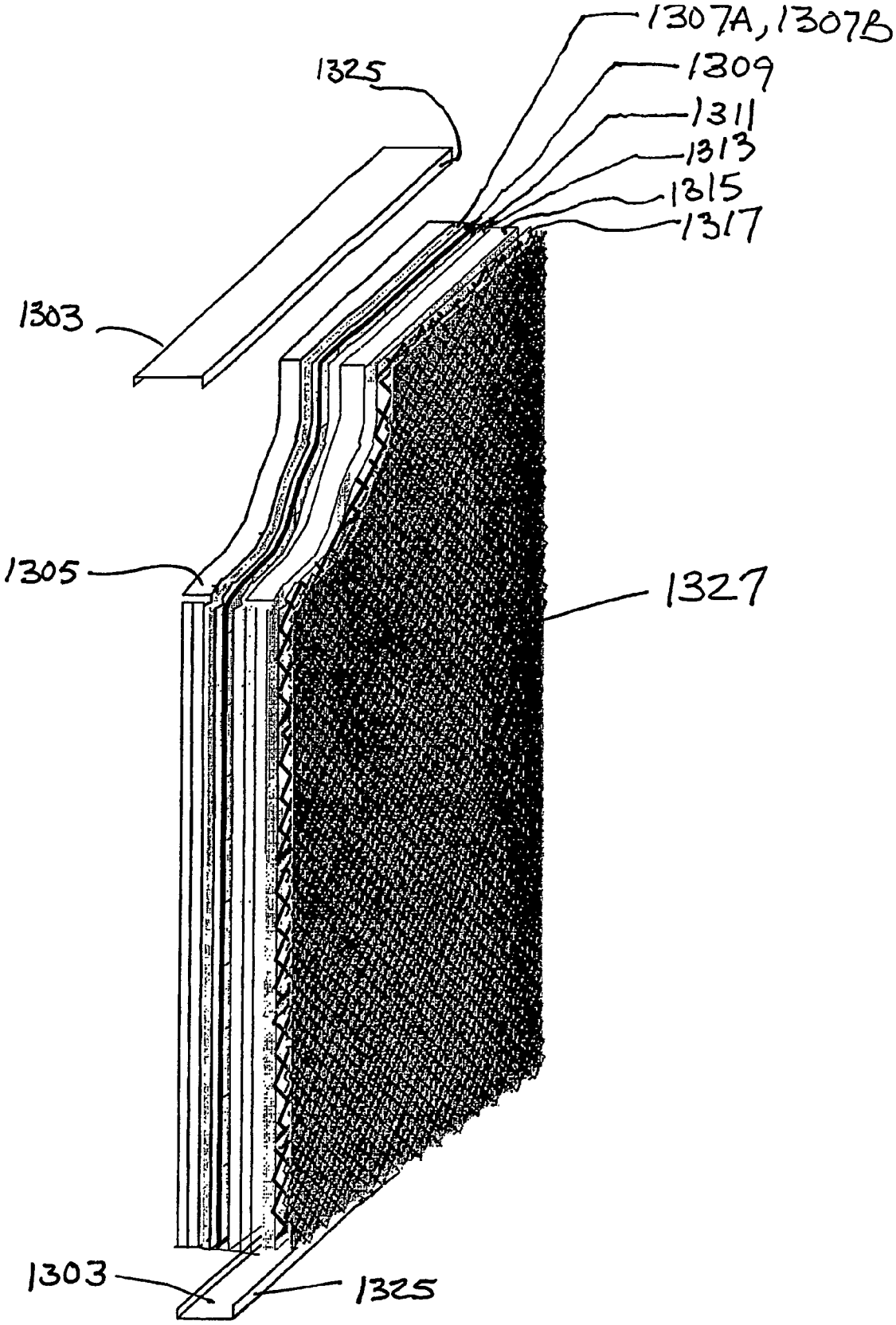
Figure 13N:
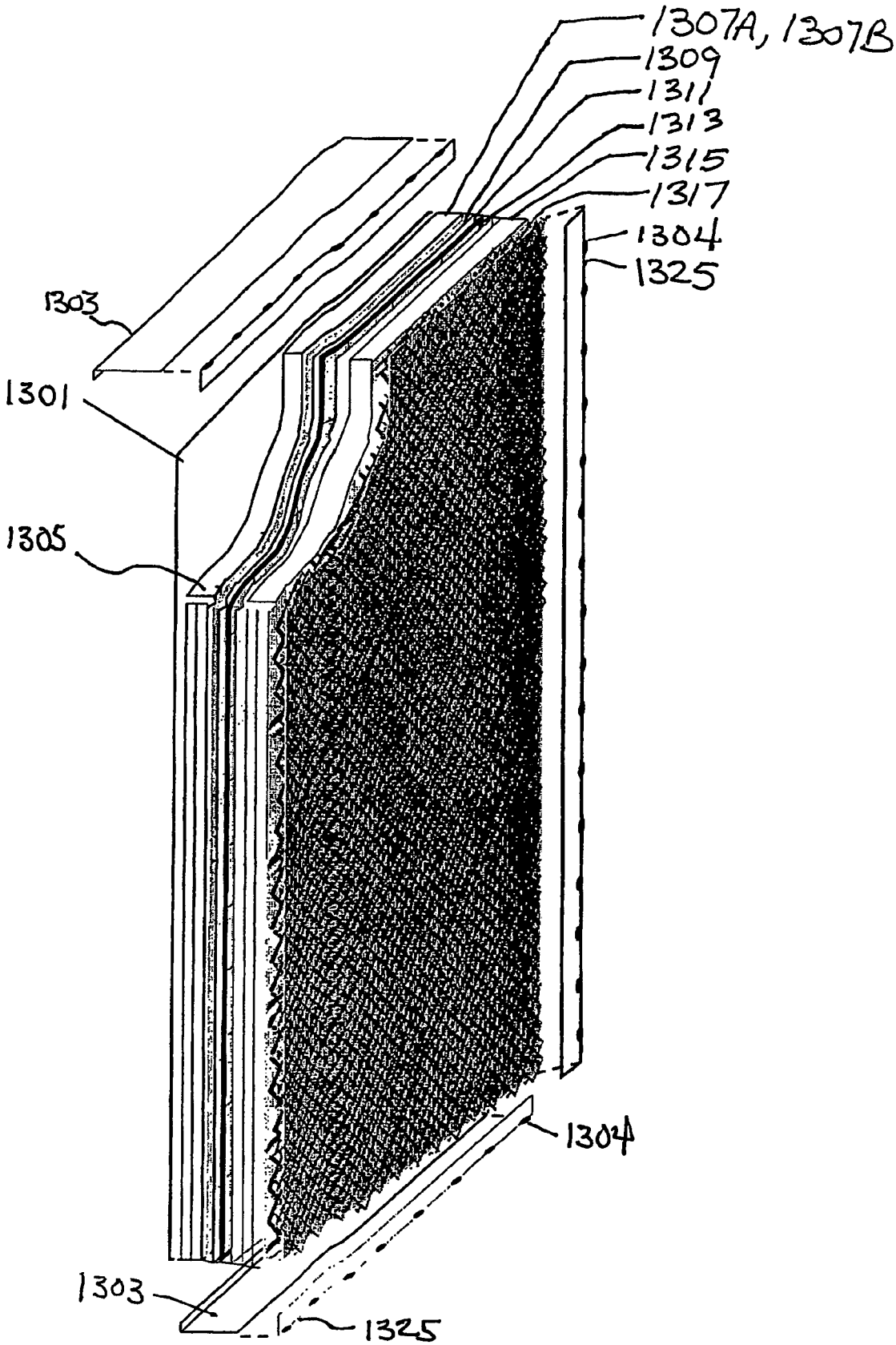

FIG. 13A to FIG. 13N illustrates an exemplary apparatus and method for making and installing a reinforced structure 1300 formed from armored panel wall sections or panel assemblies such as 200, 600, 900. The assemblies include armored panels such as 200, 600, 900 and additional components. The finished structure 1300 is illustrated in FIG. 13N.

EXAMPLE 4 describes in detail the assembly of one anti-ballistic/anti-forced entry interior or exterior armored panel/wall. The reinforced structure 1300 can serve as either structural load-bearing device used to form a structure such as a building, or as reinforcement to an existing structure such as a wall, room, building or vehicle.

In EXAMPLE 4, assemblage of the reinforced structure 1300 is described as a process for forming a new structure in which the reinforced structure 1300 serves as a load-bearing element. In this embodiment, the assemblies 200, 600, 900 can be used as an alternative to, for example, concrete slabs.

FIG. 13A is perspective view of track 1303 being installed on a floor. In FIG. 13A, a bent L-shaped, 10 gauge track 1303 is mounted to the floor and ceiling (e.g., an in-fill panel). The plurality of tracks 1303 may have a non-limiting height of 3" and a width of 10". The plurality of tracks 1303 may be placed on the floor and ceiling approximately 10" from the exterior face of the concrete. The plurality of tracks 1303 may be installed using ½"×1"-3" anchor bolts mounted in the floor and ceiling, spaced 1 meter on center (O.C.), and the pattern of the plurality of tracks 1303 may be laid out in a desired pattern before mounting the assemblies 200, 600, 900, as shown in FIG. 2, FIG. 6 and FIG. 10, respectively. Alternatively, each of the plurality of tracks 1303 can be bolted to the ceiling and/or floor as assemblies 200, 600, 900 are constructed.

Referring to FIG. 13B, after the plurality of tracks 1303 are installed, a first panel 1305 is mounted in the plurality of tracks 1303. The first panel 1305 may have a floor to ceiling clearance of about ¼". The interior surface 1301 for the reinforced structure 1300 is where electrical outlets may be installed and on which a finished wall surface may be applied. The interior side of the first panel 1303 is attached top and bottom on the vertically extending lip of the track 1303. A lip 1325 is attached to the track 1303 by welds 1304. A plurality of lips 1325 is used to hold the armored panel. The lip may be about 3" in height, and ⅞" self-tapping metal screws can be used to attach the first panel 1305 to the lip 1325. In addition screws on the top and bottom can be spaced approximately 6" apart (e.g., 3 screws per stud at the top and bottom or welding studs at the top and bottom).

First panel 1305 are attached in this manner until the entire outline of the reinforced structure 1300 is covered with framing panels 190. Attachment plates (not shown) are used to attach adjacent panels. In one embodiment, the attachment plates are at least 3"×6", 18 gauge metal plates. Four screws may be used to attach each side of a plate a first panel 1305. The first panel 1305 can include steel studs for receiving the screws. The steel studs can be 3½" wide galvanized steel studs. The outside of the first panel 1305 has a leading edge which is an 18 gauge 3½" overlap which can be attached with ⅞" self-tapping screws every 6".

Referring to FIGS. 13C-13D, once the first panel 1305 is secured, a layer of adhesive is applied to the first panel 1305. A panel seam is shown at 1306. The adhesive or tape may be applied, for example, using a ⅛" notched trowel. Once the adhesive or double-stick tape is applied, a first layer of the first set of Aramid-Fiber sheets 1307A is applied to the adhesive. The first set of Aramid-Fiber sheets 1307A and adhesive or double-stick tape are applied in conjunction with one another to prevent the adhesive from drying during assembly. The first set of Aramid-Fiber sheets 1307A can be hand rolled using a Formica roller to force the first set of Aramid-Fiber sheets 1307A to ply with the adhesive.

Any number of plies of the first set of Aramid-Fiber sheets 1307A. For example, a four ply set of Aramid-Fiber sheets 1307A may, followed by an additional layer of adhesive, and then followed by a second four ply set of Aramid-Fiber sheets 1307B. Nine plies or more may also be used.

Referring to FIG. 13E, once the last plies of the second set of Aramid-Fiber sheets 1307B are applied, another layer of adhesive is applied. A first backer board 1309 is then applied to the second set of Aramid-Fiber sheets 1307B. An exemplary embodiment of the backer board 1309 could be 5/16" thick and applied in 8' wide spans. Installation of the backer board 1309 is similar to an installation of bricks in that is adjacent seams are staggered (e.g., bricks are typically laid in a staggered or "stair-step" pattern where the seams or vertical edges of the bricks do not overlay). The backer board 1309 is then fastened to the first panel 1305 using screws and or an adhesive. The backer board 1309 should also be fastened with sheet rock screws at about 4" O.C. on the seams of the armored panel and at about 6" O.C. in the center of field of armored panel.

Referring to FIG. 13F, an additional layer of adhesive or double-stick tape is applied. The adhesive may be applied using the ¼" notched trowel. A layer of tiles 1311 is applied to the adhesive. In addition, backer board 1311 is installed with a different stagger than the one associated with backer board 1309 to assure no overlap of seams between the two backer boards. In one exemplary embodiment, the layer of tiles 1311 is formed from 8"×8" Dal-Tile Quarry tiles. The individual tiles may be applied so that they abut one another, with a minimum of space or no space left between the tiles. The tiles are applied starting at the bottom, and the final row of tiles is cut to fit at the top of the layer of tiles 1311.

Referring to FIG. 13G, adhesive is applied to the layer of tiles 1311. A second backer board 1313 is then applied to the adhesive. The second backer board 1313 may be of similar size and composition to the first backer board 1309. Using the ¼" notched trowel for the adhesive, the second backer board 1313 is attached horizontally with no corresponding seams to the layer of tiles 1311.

Referring to FIG. 13H, a second panel 1315 is installed, keeping the leading edge on the exterior. The leading edge of the second panel 1315 is screwed to an adjacent panel, such as the second backer board 1313. The screws may be spaced at about 6" along a vertical extent of the leading edge.

Referring to FIG. 13I, after the second panel 1315 is installed, a hardened steel mesh 1317, such as the AMICO Secure Fence System, can be attached to the second steel panel 1315. The hardened steel mesh 1317 will be attached every 12" to steel studs along the second panel 1315 and welded continuously on a 4" lap joint on both sides of the lap. The second panel 1315 is attached to outside edge of the L channel, using the 3" in height, 10 gauge plurality of tracks 1303, by welding the second panel 1315 to the edge of the L track previously installed. The welds should be 6" O. C., a minimum of 1" long, and repeated on all four sides.

Referring to FIG. 13J, weld a ½" rebar horizontally 1321 starting at the base and spaced every 16" up the second panel 1315. Once the rebar 1321 is welded, a tack weld of a stucco mesh 1323, such as the AMICO Secura Lath, to the ½" rebar is made every 6" across the stucco mesh 1323, as shown in FIG. 13K. Next, as shown in FIG. 13L, an exterior frame 1325 is formed from welding a lip around the edges of the second panel 1315.

In FIG. 13M, a stucco surface 1327 is applied with, for example, 1¼" total thickness of STO High Strength exterior stucco. The manufactures instructions are followed to form a finished stucco surface 1327 exterior wall. As noted above, other exterior finishes can be applied to the AMICO Secure Fence system other than stucco. These include brick, stone, etc. Finally, as shown in FIG. 13N, an interior surface, such as a ⅝" gypsum board or drywall, is attached to the first side of the first panel 1305.

Alternatively, once the second panel 1315 is installed, an exterior track lip 1315A (not shown) may be welded to the outside of the second panel 1315. Welding can be performed at 6" intervals with a minimum of 1" welds.

An exterior surface 1317 (not shown) can then be attached to the second panel 1315 using the exterior track lip 1315A (not shown). The exterior finish may be a drywall sheet or gypsum board 1317. Other exterior finishes, such as brick, stone, stucco, etc., may also be applied to the second panel 1315.

EXAMPLE 5

Figure 14:
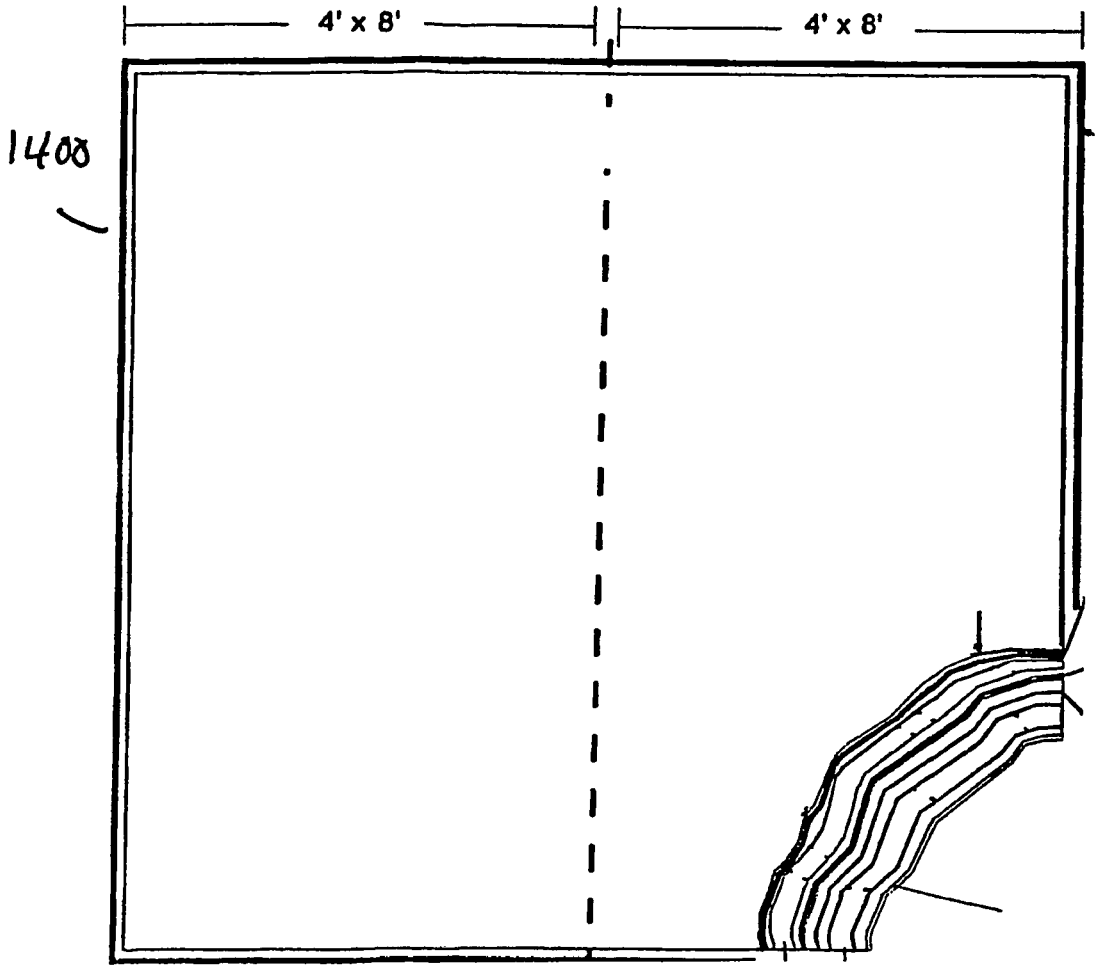
FIG. 14 is a partial cutaway view of an entry resistant wall.

FIG. 14 to FIG. 18 discloses some exemplary configurations for the armored wall panels of the present invention. FIG. 14 is a partial cutaway view of an anti-forced entry resistant wall 1400. The cutaway view illustrates the layers, as discussed above that comprise the assembly 1400. The anti-forced entry resistant wall 1400 is comprised of two 4'×8' antiballistic and anti-forced entry armored panel assemblies 1000, as shown in FIG. 10 above. A center seam is located where the two armored panels meet.

Figure 15:
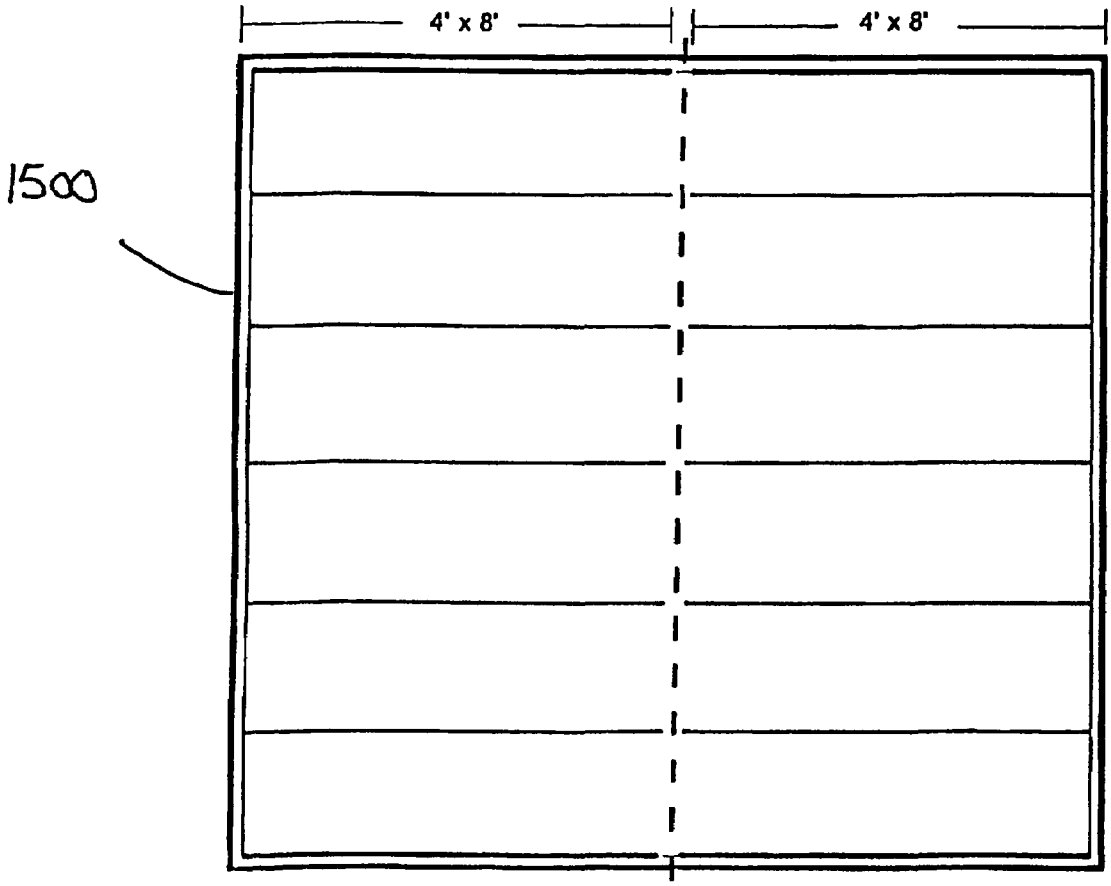
FIG. 15 is an exterior view of an entry resistant wall.

FIG. 15 is an exterior view of an antiballistic and anti-forced entry resistant wall assembly 1500 that gives some detail of the placement of the at least one of horizontal rebars, spacers and fasteners. FIG. 15 illustrates the locations of the at least one of horizontal rebars, spacers and fasteners located at least at the top and bottom and equally spaced between the top and bottom of the wall assembly 1500.

Figure 16:
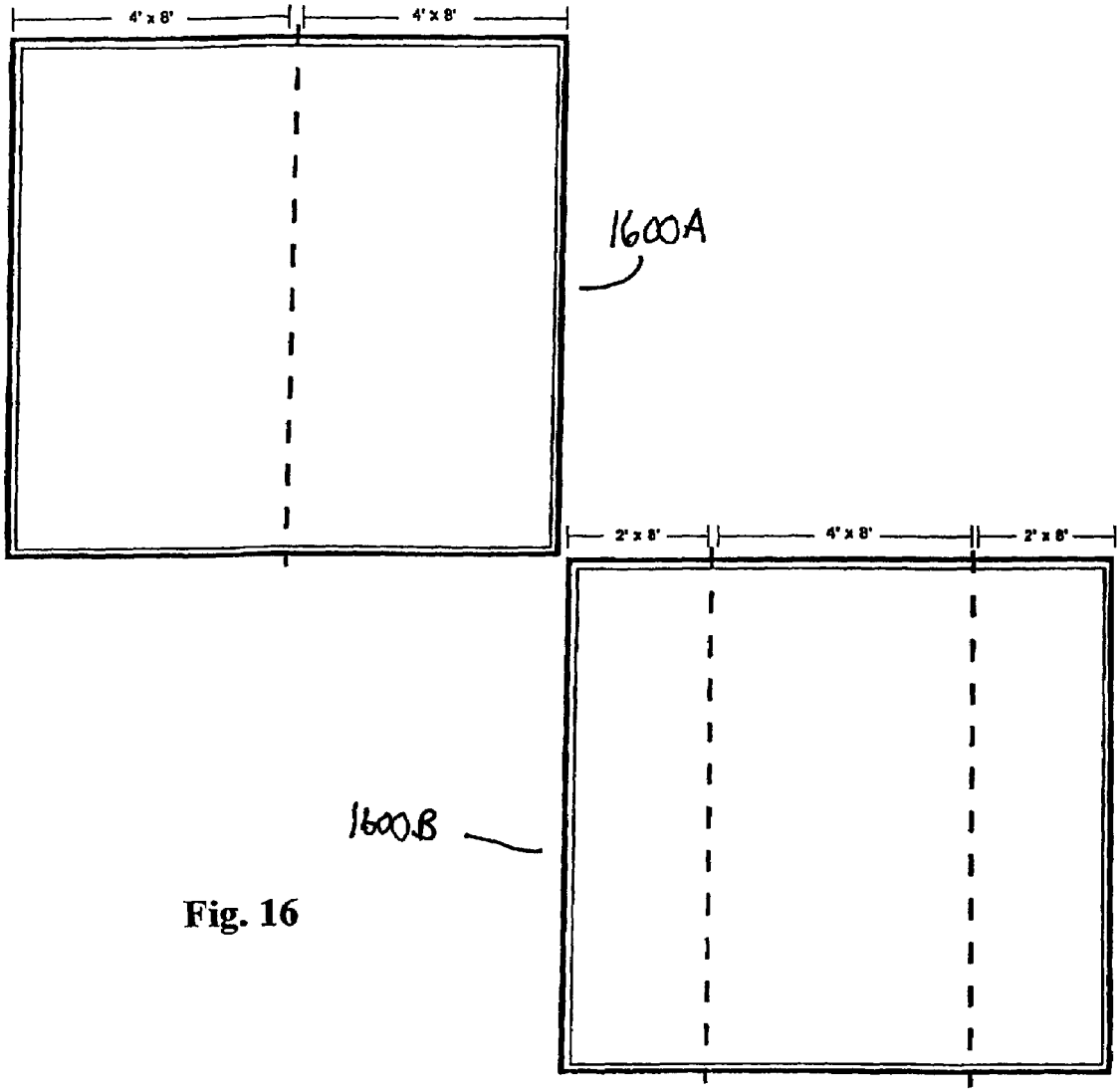
FIG. 16 is an exterior view of an entry resistant wall.

FIG. 16 is an exterior view of an antiballistic and anti-force entry armored wall assembly 1600. FIG. 16 illustrates different configuration for the first set of Aramid-Fiber sheets and second set of Aramid-Fiber sheets. As discussed above, Kevlar is a non-limiting example of an Aramid-Fiber sheet that can be applied in the present invention.

Figure 17:
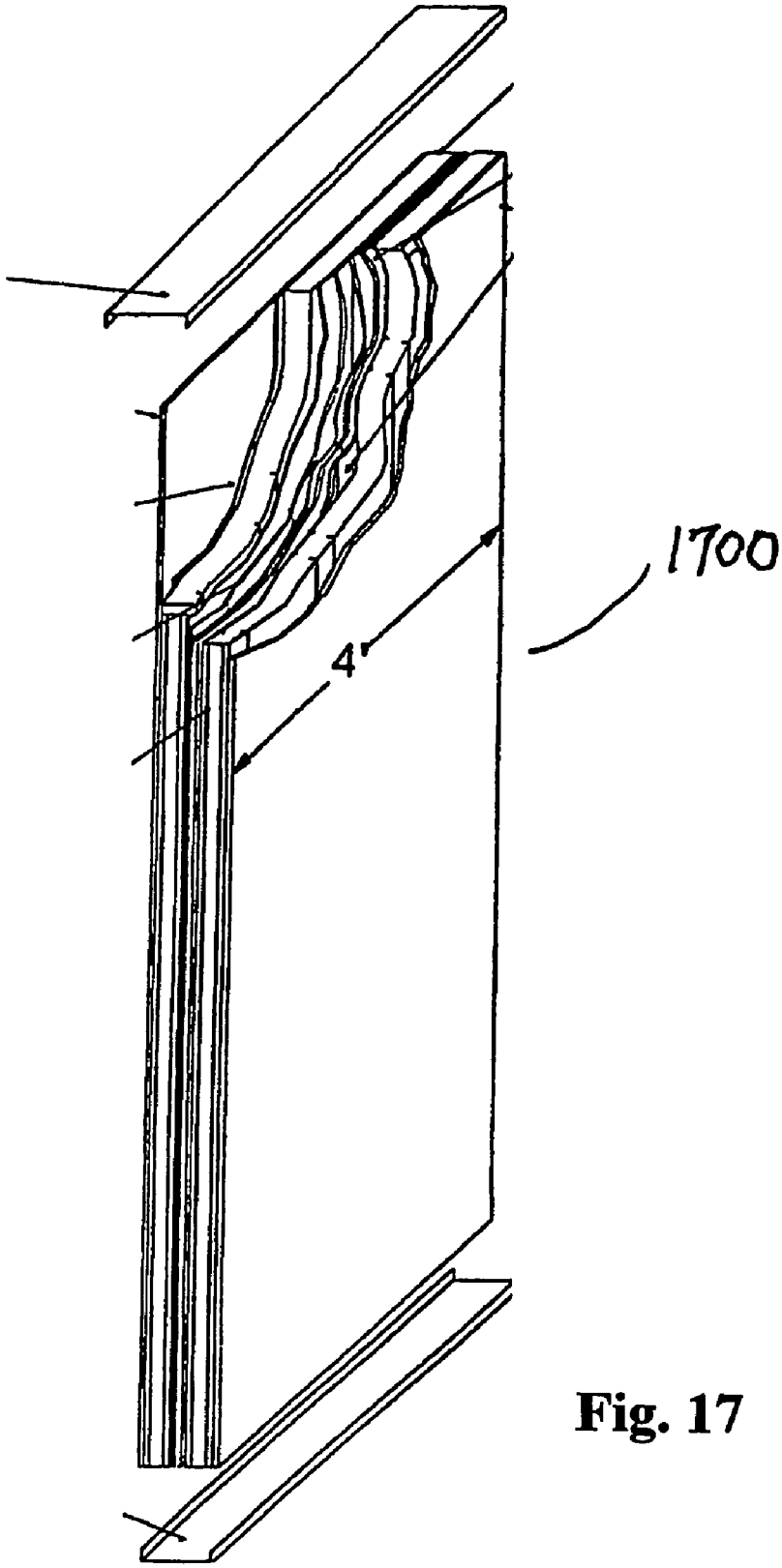
FIG. 17 is a cutaway perspective view of an entry resistant wall with a gypsum board finish.

FIG. 17 is a cutaway perspective view of an interior antiballistic wall panel assembly 1700 with a gypsum board finish. The legend of FIG. 17 provides some exemplary test results for this configuration of the armored wall panel.

The above antiballistic armored panel and wall embodiments can be used as a retrofit device to protect existing homes, buildings, other structures, and vehicles. The above embodiments can also be incorporated in the building process in new structures.

All dimensions/sizes are exemplary and other desired sizes can also be employed if desired. In addition, all materials are just one of many different suitable materials and in other embodiments, it is possible to use just some of the layers, or exchange the listed material for another material if desired for any reason (e.g., weight, fire retardancy, flexibility, stiffness, etc.).

The above embodiments have many applications. For example, the above embodiments can be configured and structurally engineered to perform, for example, as a structural wall, floor, and/or roof. Additional security and protective levels can built included, while maintaining an attractive appearance that can blend with existing structures in most communities when needed. Retrofitting of existing structures is also possible. The present materials can be used, for example, to retrofit existing structures while providing maximum protective areas. In a preferred embodiment, protection from a UL Level 8 assault is provided. The armor panel may have a rating of UL 8.

In addition, the insulation performance of the present invention provides energy savings and sound attenuation. The insulation performance of the armored wall panel is estimated to be in excess of that of R-60 rated insulation.

The present invention achieves a very high level of affordable, reliable, and reusable or replaceable building components for the workplace, residence and/or shelter. Preliminary market data indicate a cost savings of up to a factor of 20 over similar products.

Additional advantages, features and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims and their equivalents The foregoing description illustrates and describes the preferred embodiments of the present invention. As used herein and in the following claims, articles such as "the", "a" and "an" can connote the singular or plural. It is to be understood that the invention is capable of use in various other combinations, modifications, and environments and is capable of changes or modifications within the scope of the inventive concept as expressed herein, commensurate with the above teachings, and/or the skill or knowledge of the relevant art.

The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. An apparatus for an interior antiballistic armored panel for mounting on a structure, comprising:

a plurality of tracks mounted to the structure;

a second backer board attached to the plurality of tracks;

a layer of tiles attached to the second backer board;

a first backer board attached to the layer of tiles;

a second set of Aramid-Fiber sheets attached to the layer of tiles;

a first set of Aramid-Fiber sheets attached to the second set of Aramid-Fiber sheets;

a first panel with a second side attached to the first set of Aramid-Fiber sheets and with a top and bottom portion mounted to the plurality of tracks;

a plurality of lips mounted to the plurality of tracks; and an interior surface attached to at least one of a first side of the first panel and the plurality of lips, wherein at least one of self-tapping screws, fasteners and welding are used for mounting the plurality of tracks, first panel and the plurality of lips, and at least one of adhesives and tape are used for attaching the interior surface, first panel, Aramid-Fiber sheets, backer boards and layer of tiles.

2. The apparatus of claim 1, wherein the structure is at least one of a concrete floor, steel frame floor, ceilings, walls, columns and a vehicle.

3. The apparatus of claim 2, wherein the first panel is at least one of a polystyrene steel panel and a steel stud structural element.

4. The apparatus of claim 3, wherein the first panel has a thickness in a range from 3½" to 7½".

5. The apparatus of claim 4, wherein the first panel is insulated.

6. The apparatus of claim 5, wherein the first set of Aramid-Fibers and second set of Aramid-Fibers are each at least 4 layers thick.

7. The apparatus of claim 6, wherein the first backer board and second backer board are cementous backer boards.

8. The apparatus of claim 7, wherein the first backer board and second backer board are fireproof backer boards.

9. The apparatus of claim 8, wherein the first backer board and second backer board have a thickness in a range from ¼" to ½".

10. The apparatus of claim 9, wherein the layer of tiles is made from individual tiles.

11. The apparatus of claim 10, wherein at least one of quarry tiles and paver tiles are used to form the layer of tiles.

12. The apparatus of claim 11, wherein the layer of tiles has a thickness from ¼" to ½.

13. The apparatus of claim 12, wherein the exterior surface is made of gypsum board that has a thickness of ⅝".

14. The apparatus of claim 13, wherein the adhesives are at least one of polyurethane and urethane.

15. The apparatus of claim 13, wherein the tape is at least one of double-stick tape, double coated acrylic foam tape and adhesive transfer tape.

16. A method for making an interior antiballistic armored panel for mounting on a structure, comprising:

mounting a plurality of tracks on the structure;

attaching a second backer board to the plurality of tracks;

attaching a layer of tiles to the second backer board;

attaching a first backer board to the layer of tiles;

attaching a second set of Aramid-Fiber sheets to the first backer board;

attaching a first set of Aramid-Fiber sheets to the second set of Aramid Fiber sheets;

attaching a second side of a first panel to the first set of Aramid-Fiber sheets; mounting a top and bottom of the first panel to the plurality of tracks;

mounting a plurality of lips to the plurality of tracks;

attaching an interior surface to first side of the first panel, wherein at least one of self-tapping screws, fasteners and welding are used for mounting the plurality of tracks and the first panel, and at least one of adhesives and tape are used for attaching the interior surface, first panel, Aramid-Fiber sheets, backer boards and layer of tiles.

17. The method of claim 16, wherein the structure is at least one of a concrete floor, steel frame floor, ceilings, walls, columns and a vehicle.

18. The method of claim 17, wherein the first panel is at least one of a polystyrene steel panel and a steel stud structural element.

19. The method of claim 18, wherein the first panel has a thickness in the range from 3½" to 7½".

20. The method of claim 19, wherein the first panel is insulated.

21. The method of claim 20, wherein the first set of Aramid-Fibers and second set of Aramid-Fibers are each at least 4 layers thick.

22. The method of claim 21, wherein the first backer board and second backer board are cementous backer boards.

23. The method of claim 22, wherein the first backer board and second backer board are fireproof backer boards.

24. The method of claim 23, wherein the first backer board and second backer board have a thickness in a range from ¼" to ½".

25. The method of claim 24, wherein the layer of tiles is made from individual tiles.

26. The method of claim 25, wherein at least one of quarry tiles and paver tiles are used to form the layer of tiles.

27. The method of claim 26, wherein the layer of tiles has a thickness from ¼" to ½".

28. The method of claim 27, wherein the exterior surface is made of gypsum board that has a thickness of ⅝".

29. The method of claim 28, wherein the adhesives are at least one of polyurethane and urethane.

30. The method of claim 28, wherein the tape is at least one of double-stick tape, double coated acrylic foam tape and adhesive transfer tape.

31. An apparatus for an antiballistic armored panel for mounting on a structure, comprising:

a plurality of tracks mounted to the structure;

a first panel mounted at a top and bottom portion to the plurality of tracks;

a first set of Aramid-Fiber sheets attached to a second side of the first panel;

a second set of Aramid-Fiber sheets attached to the first set of Aramid-Fiber sheets;

a first backer board attached to the second set of Aramid-Fiber sheets;

a layer of tiles attached to the first backer board;

a second backer board attached to the layer of tiles;

a second panel attached on a first side to the second backer board and mounted at a top and bottom portion to the plurality of tracks;

a plurality of lips mounted to the plurality of tracks;

an exterior surface attached to a second side of the second panel; and an interior surface attached to a first side of the first panel, wherein at least one of self-tapping screws, fasteners and welding are used for mounting the plurality of tracks, first panel, second panel and plurality of lips, and at least one of adhesives and tape are used for attaching the Aramid-Fiber sheets, backer boards, layer of tiles, exterior surface and interior surface.

32. The apparatus of claim 31, wherein the structure is at least one of a concrete floor, steel frame floor, ceilings, walls, columns and a vehicle.

33. The apparatus of claim 32, wherein the first panel and second panel are at least one of a polystyrene steel panel and a steel stud structural element.

34. The apparatus of claim 33, wherein the first panel has a thickness in the range from 3½" to 7½".

35. The apparatus of claim 34, wherein at least one of the first panel and second panel is insulated.

36. The apparatus of claim 35, wherein the first set of Aramid-Fibers and second set of Aramid-Fibers are each at least 4 layers thick.

37. The apparatus of claim 36, wherein the first backer board and second backer board are cementous backer boards.

38. The apparatus of claim 37, wherein the first backer board and second backer board are fireproof backer boards.

39. The apparatus of claim 38, wherein the first backer board and second backer board have a thickness in a range from ¼" to ½".

40. The apparatus of claim 39, wherein the layer of tiles is made from individual tiles.

41. The apparatus of claim 40, wherein at least one of quarry tiles and paver tiles are used to form the layer of tiles.

42. The apparatus of claim 41, wherein the layer of tiles has a thickness from ¼" to ½".

43. The apparatus of claim 42, wherein the interior surface and the exterior surface are made of gypsum board that has a thickness of ⅝".

44. The apparatus of claim 43, wherein the adhesives are at least one of polyurethane and urethane.

45. The apparatus of claim 43, wherein the tape is at least one of double-stick tape, double coated acrylic foam tape and adhesive transfer tape.

46. A method for making an antiballistic armored panel for mounting on a structure, comprising:

mounting a plurality of tracks on the surface;

mounting a top and bottom portion of a first panel to the plurality of tracks;

attaching a first set of Aramid-Fiber sheets to a second side of the first panel;

attaching a second set of Aramid-Fiber sheets to the first set of Aramid Fiber sheets;

attaching a first backer board to the second set of Aramid-Fiber sheets;

attaching a layer of tile to the first backer board;

attaching a second backer board to the layer of tiles;

attaching a second panel to the second backer board;

mounting a top and bottom of the second panel to the plurality of tracks;

mounting a plurality of lips to the plurality of tracks;

attaching an exterior surface to a second side of the second panel;

finishing the exterior surface with at least one of brick, stone and other external finishing materials; and attaching an interior surface to the first side of the first panel, wherein at least one of self-tapping screws, fasteners and welding are used for mounting the plurality of tracks, first panel, second panel and the plurality of lips, and at least one of adhesives and tape are used for attaching the Aramid-Fiber sheets, backer boards, layer of tiles, exterior surface and interior surface.

47. The method of claim 46, wherein the structure is at least one of a concrete floor, steel frame floor, ceilings, walls, columns and a vehicle.

48. The method of claim 47, wherein the first panel and second panel are at least one of a polystyrene steel panel and a steel stud structural element.

49. The method of claim 48, wherein the first panel has a thickness in the range from 3½" to 7½".

50. The method of claim 49, wherein at least one of the first panel and second panel is insulated.

51. The method of claim 50, wherein the first set of Aramid-Fibers and second set of Aramid-Fibers are each at least 4 layers thick.

52. The method of claim 51, wherein the first backer board and second backer board are cementous backer boards.

53. The method of claim 52, wherein the first backer board and second backer board are fireproof backer boards.

54. The method of claim 53, wherein the first backer board and second backer board have a thickness in a range from ¼" to ½".

55. The method of claim 54, wherein the layer of tiles is made from individual tiles.

56. The method of claim 55, wherein at least one of quarry tiles and paver tiles are used to form the layer of tiles.

57. The method of claim 56, wherein the layer of tiles has a thickness from ¼" to ½".

58. The method of claim 57, wherein the interior surface and the exterior surface are made of gypsum board that has a thickness of ⅝".

59. The method of claim 58, wherein the adhesives are at least one of polyurethane and urethane.

60. The method of claim 58, wherein the tape is at least one of double-stick tape, double coated acrylic foam tape and adhesive transfer tape.

61. An apparatus for an antiballistic/anti-forced entry armored panel for mounting on a structure, comprising:

a plurality of tracks mounted to the structure;

a first panel attached at a top and bottom portion to the plurality of tracks;

a first set of Aramid-Fiber sheets attached to a first side of the first panel;

a second set of Aramid-Fiber sheets attached to the first set of Aramid-Fiber sheets;

a first backer board attached to the second set of Aramid-Fiber sheets;

a layer of tiles attached to the first backer board;

a second backer board attached to the layer of tiles;

a second panel attached to the second backer board and mounted at the top and bottom to the plurality of tracks;

a hardened steel mesh attached to the second panel by at least one of seaming and continuous welding;

horizontal steel frame members attached to the hardened steel mesh by welding;

at least one of horizontal rebars, spacers and fasteners attached to the hardened steel mesh by tack welding, located at least at the top and bottom of the second panel and at equally spaced at intervals between the top and bottom of the second panel;

a stucco mesh attached to the at least one of horizontal rebars, spacers and fasteners by welding;

a plurality of lips mounted to the plurality of tracks and spaced at intervals along edges of the stucco mesh;

high strength stucco applied to the stucco mesh; and an interior surface attached to a first side of the first panel, wherein at least one of self-tapping screws, fasteners and welding are used for mounting the plurality of tracks, first panel, second panel and plurality of lips, and at least one of adhesives and tape are used for attaching the Aramid-Fiber sheets, backer boards, layer of tiles and interior surface.

62. The apparatus of claim 61, wherein the structure is at least one of a concrete floor, steel frame floor, ceilings, walls, columns and a vehicle.

63. The apparatus of claim 62, wherein the first panel and second panel are at least one of a polystyrene steel panel and a steel stud structural element.

64. The apparatus of claim 63, wherein the first panel has a thickness in the range from 3½" to 7½".

65. The apparatus of claim 64, wherein at least one of the first panel and second panel is insulated.

66. The apparatus of claim 65, wherein the first set of Aramid-Fibers and second set of Aramid-Fibers are each at least 4 layers thick.

67. The apparatus of claim 66, wherein the first backer board and second backer board are cementous backer boards.

68. The apparatus of claim 67, wherein the first backer board and second backer board are fireproof backer boards.

69. The apparatus of claim 68, wherein the first backer board and second backer board have a thickness in a range from ¼" to ½".

70. The apparatus of claim 69, wherein the layer of tiles is made from individual tiles.

71. The apparatus of claim 70, wherein at least one of quarry tiles and paver tiles are used to form the layer of tiles.

72. The apparatus of claim 71, wherein the layer of tiles has a thickness from ¼" to ½".

73. The apparatus of claim 72, wherein the exterior surface is made of gypsum board that has a thickness of ⅝".

74. The apparatus of claim 73, wherein the adhesives are at least one of polyurethane and urethane.

75. The apparatus of claim 73, wherein the tape is at least one of double-stick tape, double coated acrylic foam tape and adhesive transfer tape.

76. A method for making an antiballistic and anti-forced entry armored panel for mounting on a structure, comprising:

mounting a plurality of tracks on the structure;

mounting a top and bottom of a first panel to the plurality of tracks;

attaching a first set of Aramid-Fiber sheets to the first panel;

attaching a second set of Aramid-Fiber sheets to the first set of Aramid Fiber sheets;

attaching a first backer board to the second set of Aramid-Fiber sheets;

attaching a layer of tile to the first backer board;

attaching a second backer board to the layer of tiles;

attaching a second panel to the second backer board;

mounting a top and bottom portion of the second panel to the plurality of tracks;

at least one of seaming and continuous welding a hardened steel mesh to the second panel;

welding horizontal steel frame members to the hardened steel mesh;

tack welding at least one of horizontal rebars, spacers and fasteners at least at the top and bottom of the second panel and at equally spaced intervals between the top and bottom of the second panel;

tack welding stucco mesh to the at least one of horizontal rebars, spacers and fasteners;

mounting a plurality of lips at intervals spaced along edges of the stucco mesh to the plurality of tracks;

applying high strength stucco to the stucco mesh to form an exterior surface; and attaching an interior surface to a first side of the first panel, wherein at least one of self-tapping screws, fasteners and welding are used for mounting the plurality of tracks, first panel, second panel and plurality of tracks, and at least one of adhesives and tape are used for attaching the Aramid-Fiber sheets, backer boards, layer of tiles and interior surface.

77. The method of claim 76, wherein the structure is at least one of a concrete floor, steel frame floor, ceilings, walls, columns and a vehicle.

78. The method of claim 77, wherein the first panel and the second panel are at least one of a polystyrene steel panel and a steel stud structural element.

79. The method of claim 78, wherein the first panel has a thickness in the range from 3½" to 7½".

80. The method of claim 79, wherein the first panel and second panel are insulated.

81. The method of claim 80, wherein the first set of Aramid-Fibers and second set of Aramid-Fibers are each at least 4 layers thick.

82. The method of claim 81, wherein the first backer board and second backer board are cementous backer boards.

83. The method of claim 82, wherein the first backer board and second backer board are fireproof backer boards.

84. The method of claim 83, wherein the first backer board and second backer board have a thickness in a range from ¼" to ½".

85. The method of claim 84, wherein the layer of tiles is made from individual tiles.

86. The method of claim 85, wherein at least one of quarry tiles and paver tiles are used to form the layer of tiles.

87. The method of claim 86, wherein the layer of tiles has a thickness from ¼" to ½".

88. The method of claim 87, wherein the exterior surface is made of gypsum board that has a thickness of ⅝".

89. The method of claim 88, wherein the adhesives are at least one of polyurethane and urethane.

90. The method of claim 88, wherein the tape is at least one of double-stick tape, double coated acrylic foam tape and adhesive transfer tape.

91. An antiballistic armored panel capable of achieving up to UL Level 8, said panel comprising one or more of the following materials: gypsum board, a structural pre-insulated light gauge steel component, a commercial grade adhesive and/or tape, cementeous board, commercial grade quarry tiles, tempest mesh Aramid-Fiber sheets and/or KEVLAR®, and wherein said panel comprises less than 25% by weight of reinforced concrete and less than 25% by weight of ballistic steel.

92. The antiballistic armored panel of claim 91, wherein said panel comprises less than 5% by weight of reinforced concrete and less than 5% by weight of ballistic steel.

93. The antiballistic armored panel of claim 91, wherein said panel is free of reinforced concrete and ballistic steel.

* * * * *